US007526236B2

(12) United States Patent
Kubota et al.

(10) Patent No.: US 7,526,236 B2
(45) Date of Patent: Apr. 28, 2009

(54) WASTE DEVELOPER COLLECTING DEVICE, IMAGE FORMING APPARATUS, AND WASTE DEVELOPER COLLECTING METHOD

(75) Inventors: Hiroshi Kubota, Kadoma (JP); Yasuyuki Ishiguro, Higashiosaka (JP); Koichi Mihara, Fujiidera (JP)

(73) Assignee: Sharp Kabushiki Kaisha, Osaka (JP)

( * ) Notice: Subject to any disclaimer, the term of this patent is extended or adjusted under 35 U.S.C. 154(b) by 485 days.

(21) Appl. No.: 11/385,769

(22) Filed: Mar. 22, 2006

(65) Prior Publication Data

US 2006/0216066 A1 Sep. 28, 2006

(30) Foreign Application Priority Data

Mar. 25, 2005 (JP) ..... 2005-089924

(51) Int. Cl.
*G03G 15/08* (2006.01)
*G03G 21/12* (2006.01)

(52) U.S. Cl. ..... 399/257; 399/360

(58) Field of Classification Search ..... 399/257, 399/358, 360

See application file for complete search history.

(56) References Cited

U.S. PATENT DOCUMENTS 4,530,594 A * 7/1985 Adachi ..... 399/360
5,781,841 A * 7/1998 Kouroku et al. ..... 399/360
5,933,690 A * 8/1999 Sugimoto et al. ..... 399/257
2003/0137675 A1 7/2003 Minagaw
2008/0031654 A1 2/2008 Minagawa

FOREIGN PATENT DOCUMENTS

| | | | |
|---|---|---|---|
| CN | 1430112 | A | 7/2003 |
| JP | 1-71757 | U | 5/1989 |
| JP | 6-89061 | A | 3/1994 |
| JP | 6-278739 | A | 10/1994 |
| JP | 8-328366 | A | 12/1996 |
| JP | 2000-155460 | A | 6/2000 |
| JP | 2004-61958 | A | 2/2004 |
| JP | 2005-37664 | A | 2/2005 |
| JP | 2005-077513 | | 3/2005 |

* cited by examiner

*Primary Examiner*—Sandra L Brase
(74) *Attorney, Agent, or Firm*—Nixon & Vanderhye, P.C.

(57) ABSTRACT

A waste developer collecting device included in a color tandem image forming apparatus which forms an image using K (black), C (cyan), M (magenta), and Y (yellow) developers includes a collecting container which can be attached to a developing device storing the C developer, a developing device storing the M developer, and a developing device storing the Y developer at the same time and which collects the C, M, and Y developers discharged from the respective developing devices. With this, it is possible to efficiently discharge and collect the developers.

27 Claims, 16 Drawing Sheets

WASTE DEVELOPER COLLECTING DEVICE, IMAGE FORMING APPARATUS, AND WASTE DEVELOPER COLLECTING METHOD

This Nonprovisional application claims priority under 35U.S.C. § 119(a) on Patent Application No. 089924/2005 filed in Japan on Mar. 25, 2005, the entire contents of which are hereby incorporated by reference.

FIELD OF THE DISCLOSURE

The present technology relates to (i) an image forming apparatus which visualizes with a powder developer an electrostatic latent image formed on a photoreceptor by an electrophotographic recording method or an electrostatic recording method, (ii) a waste developer collecting device included in the image forming apparatus, and (iii) a method for collecting a waste developer.

BACKGROUND OF THE DISCLOSURE

In an image forming apparatus using a two component development method which uses toner and carrier, image defects, such as an image density and fog, occur when the life of a developer ends. On this account, when the life of developer ends, it is necessary to discharge the developer to exchange it for the new one.

For example, Japanese Laid-Open Utility Model Publication No. 71757/1989 (Jitsukaihei 1-71757, published on May 15, 1989) discloses a method for discharging the developer by (i) taking out a developing device from a main body, and then (ii) with a discharge opening of the developing device facing downward, rotating a coupling by hand or by external idling.

However, there are problems in that discharging and exchanging the developer is troublesome and take time. Specifically, for example, in a tandem color copying machine, the developing device has been miniaturized, so that it is difficult to discharge the developer.

Meanwhile, various image forming apparatuses including means for automatically discharging the developer have been proposed. For example, Japanese Unexamined Patent Publication No. 89061/1994 (Tokukaihei 6-89061, published on Mar. 29, 1994) discloses a technique of automatically discharging the developer by providing a discharging roller in addition to an agitating roller. In addition, this Tokukaihei 6-89061 also proposes a development apparatus including an automatic developer discharging means whose efficiency of discharging the developer is enhanced by increasing the size of the diameter of one conveying screw provided closer to the bottom of a developer tank than another conveying screw. Moreover, Japanese Unexamined Patent Publication No. 61958/2004 (Tokukai 2004-61958, published on Feb. 26, 2004) proposes an automatic developer discharging technique of automatically discharging the developer from the developing device and automatically injecting the new developer. Further, Japanese Unexamined Patent Publication No. 155460/2000 (Tokukai 2000-155460, published on Jun. 6, 2000) proposes a technology of (i) surely discharging the developer by detecting an output voltage of a toner concentration sensor when the developer is being discharged automatically and (ii) stabilizing the amount of the new developer injected.

However, in a conventional image forming apparatus (for example, a color tandem image forming apparatus) which includes a plurality of developer tanks for storing the developers, when discharging the developers, it is necessary to repeatedly carry out, for each developer tank, a process of (i) attaching to the developer tank a collecting container for collecting the developer and (ii) discharging the developer. This is low in work efficiency.

For example, in an image forming apparatus including a developer tank containing a K (black) developer, a developer tank containing a C (cyan) developer, a developer tank containing a M (magenta) developer, and a developer tank containing a Y (yellow) developer, in many cases, the cyan, magenta, and yellow developers are exchanged for the new ones at the same time. Since the operation of exchanging the developer is troublesome and takes time, it is done by a professional service person in many cases. In this case, the cyan, magenta, and yellow developers are usually exchanged at the same time. In this case, it is necessary to attach and detach the collecting container for each color, which lowers the work efficiency.

Moreover, when the developer is exchanged by the service person, the collecting container for the developer is usually prepared by the service person. However, in this case, it is necessary to prepare the collecting containers the number of which is equal to the number of the developer tanks. Since the collecting container is in the form of a box and voluminous, it is difficult for the service person to move with the collecting containers, and this leads to the low work efficiency.

Moreover, in the above-described conventional technology, there are problems in that it is difficult to completely discharge the developer and the developer remains at the bottom of the developer tank. For example, in the above-described Tokukaihei 6-89061, the efficiency of discharging the developer is enhanced by increasing the size of the diameter of one conveying screw provided closer to the bottom of the developer tank than another conveying screw.

However, in the case of providing the conveying screws in the developer tank, a certain gap (for example, 1 mm or more) is provided between the conveying screw and the developer tank to prevent pinching of the developer, etc. between the conveying screw and the developer tank. Therefore, it is not possible to discharge the developer remaining in the gap between the conveying screw and the developer tank. On this account, the developer remains in the developer tank in some cases. If the developer remaining in the developer tank is mixed with the new developer injected, the quality of the developer may deteriorate. Therefore, it is preferable to remove the developer remaining in the developer tank. In this case, in addition to a normal discharging operation, it is necessary to carry out an additional troublesome operation of removing the remaining developer. This is low in work efficiency.

SUMMARY OF THE DISCLOSURE

The present technology was made to solve the above-described problems, and an object of the technology is to provide (i) a waste developer collecting device which can discharge and collect the developer efficiently, (ii) an image forming apparatus including the waste developer collecting device, and (iii) a method for collecting the waste developer.

To solve the above-described problems, (i) a waste developer collecting device is included in an image forming apparatus including a plurality of developing devices which respectively carry out development processes with developers containing toner and carrier, (ii) the waste developer collecting device collects waste developers used in and discharged from the developing devices, (iii) the waste developer collecting device includes: a collecting container for collecting the developers discharged from the developing devices; and a collecting container fixing section for fixing the collecting container by causing the collecting container to be positioned so that the collecting container is able to collect the developers discharged from the developing devices, and (iv) the collecting container is provided at a specific fixed position by the collecting container fixing section so that the collecting container is able to collect the developers discharged from at least two or more of the above-described plurality of the developing devices.

According to the above-described configuration, the collecting container is fixed at the specific fixed position, so that the collecting container can collect at this fixed position the developers discharged from a plurality of the developing devices. Therefore, when collecting the developers discharged from at least two or more developing devices, it is not necessary to attach one collecting container for each developing device. On this account, the developer can be discharged and collected efficiently. Moreover, to collect the developers discharged from at least two or more developing devices, it is not necessary to prepare and carry a plurality of the collecting containers. Therefore, it is possible to improve the work efficiency.

Moreover, to solve the above-described problems, (i) another waste developer collecting device collects a waste developer used in and discharged from a developing device which carries out a development process with a developer containing toner and carrier, (ii) the waste developer collecting device includes: a collecting container for collecting the developer discharged from the developing device; and a collecting container fixing section for fixing the collecting container by causing the collecting container to be positioned so that the collecting container is able to collect the developer discharged from the developing device, and (iii) the collecting container includes a collecting tank, which is a bag made of a soft elastic body, for storing the developer collected.

In the waste developer collecting device configured as above, the collecting tank included in the collecting container is the bag made of the soft elastic body. Note that the bag made of the elastic body is a bag which can easily change its shape. Examples of the bag made of the soft elastic body are a bag made of synthetic resin, such as a plastic bag and a polyethylene bag, and a bag made of paper, cloth, rubber a metal film, etc. Thus, by using as the collecting tank of the collecting container the bag made of the soft elastic body which can easily change its shape, for example, the carrier can carry the collecting container easily by changing the shape of the bag. Thus, the work efficiency can be improved, and a space for keeping the collecting container can be saved.

Moreover, to solve the above-described problems, (i) still another waste developer collecting device collects a waste developer used in and discharged from a developing device which carries out a development process with a developer containing toner and carrier, and (ii) the developing device includes: a developer tank for storing the developer; a developer discharge opening which is formed at a bottom of the developer tank and is openable and closable; a conveying section for conveying to the developer discharge opening the developer stored in the developer tank; and an interval change section which changes an interval between the bottom of the developer tank and the conveying section.

According to the above-described configuration, it is possible to change the interval between the bottom of the developer tank and the conveying section. Therefore, for example, by narrowing the interval between the conveying section and the bottom of the developer tank when the amount of the developer in the developer tank is a predetermined amount or smaller, it is possible to efficiently discharge the developer remaining between the conveying section and the bottom of the developer tank, although it is difficult for the conventional techniques to discharge this remaining developer. That is, it is possible to reduce the amount of the developer remaining in the developer tank, and it is possible to efficiently discharge the developer.

To solve the above-described problems, an image forming apparatus includes the waste developer collecting device having any one of the above-described configurations. On this account, the developer can be discharged and collected efficiently.

To solve the above-described problems, (i) a waste developer collecting method is a method for collecting a waste developer used in and discharged from a developing device including: a developer tank for storing a developer containing toner and carrier; a developer discharge opening which is formed at a bottom of the developer tank and is openable and closable; and a conveying section for conveying to the developer discharge opening the developer stored in the developer tank, (ii) the waste developer collecting method includes the steps of: detecting an amount of the developer in the developer tank; and changing an interval between a bottom of the developer tank and the conveying section in according with a result of a detection in the above-described detecting step.

According to this method, the interval between the bottom of the developer tank and the conveying section is changed in accordance with the result of the detection of the amount of the developer in the developer tank. Therefore, by narrowing the interval between the conveying section and the bottom of the developer tank when the result of the detection indicates that the amount of the developer in the developer tank is a predetermined amount of smaller, it is possible to reduce the amount of the developer remaining in the developer tank, and it is possible to efficiently discharge the developer.

Additional objects, features, and strengths will be made clear by the description below. Further, the advantages will be evident from the following explanation in reference to the drawings.

BRIEF DESCRIPTION OF THE DRAWINGS

FIG. 7 is attached to the waste developer collecting device of one embodiment.

DESCRIPTION OF THE EMBODIMENTS

The following will explain one embodiment of the present disclosure.

[Image Forming Apparatus 100]

Figure 2:
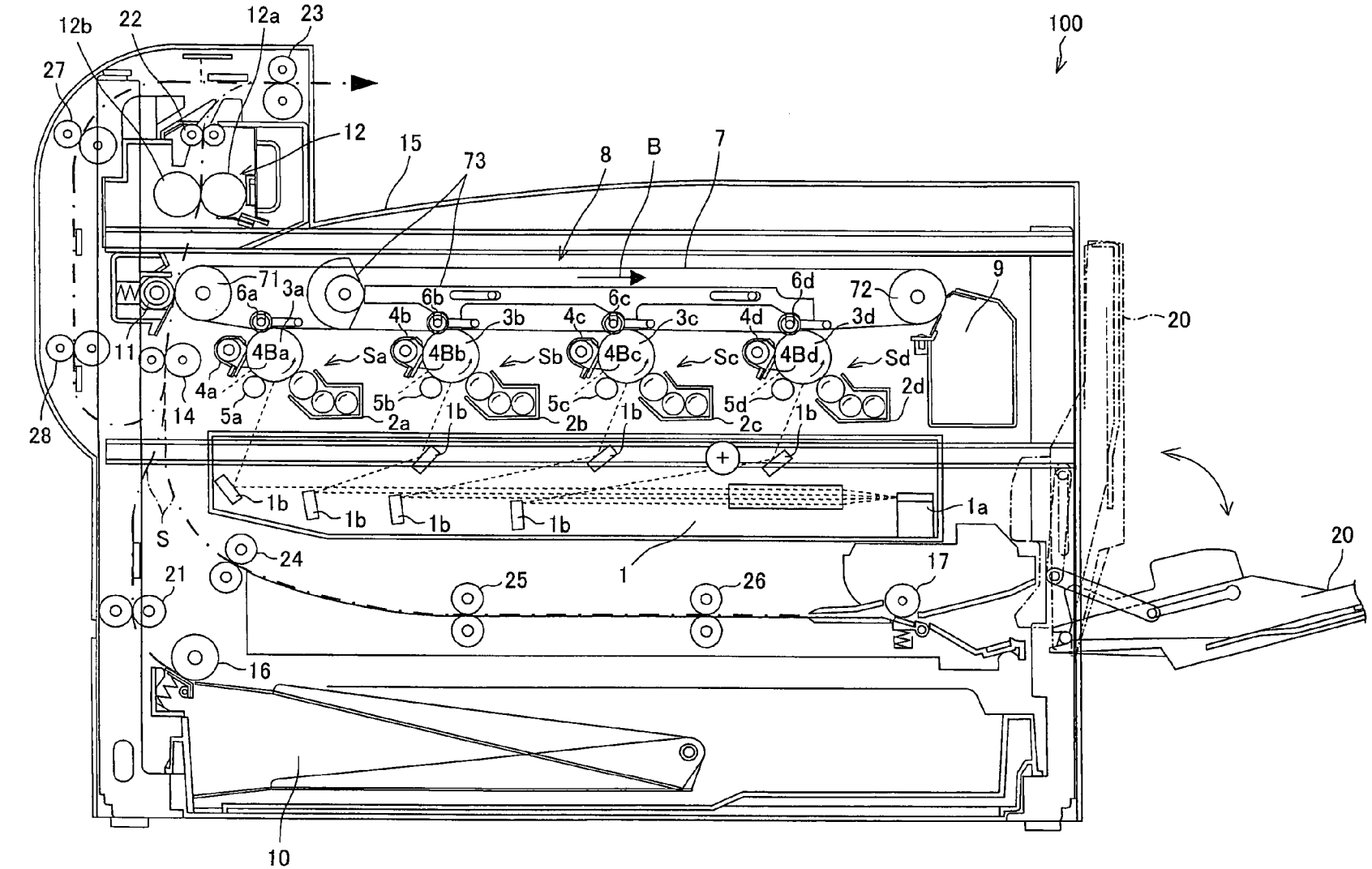
FIG. 2 is a cross-sectional view showing a schematic configuration of an image forming apparatus including the waste developer collecting device of one embodiment.

FIG. 2 is a cross-sectional view showing a schematic configuration of an image forming apparatus 100 which is one example of an image forming apparatus. The image forming apparatus 100 is a color tandem image forming apparatus which forms a multicolor image or a unicolor image on a recording sheet (paper) in accordance with image data supplied externally.

As shown in FIG. 2, the image forming apparatus 100 includes an exposure unit 1, developing devices 2*a* to 2*d*, photosensitive drums 3*a* to 3*d*, electrifying devices 5*a* to 5*d*, cleaner unit 4*a* to 4*d*, an intermediate transfer belt 7, an intermediate transfer belt unit 8, a fixing unit 12, a paper conveyance path S, a paper feed tray, 10, a paper receiving tray 15, etc. Operations of these members included in the image forming apparatus 100 are controlled by a main control section (not shown) of the image forming apparatus 100.

The image data handled in the image forming apparatus 100 corresponds to a color image using black (K), cyan (C), magenta (M), and yellow (Y) colors. Therefore, as shown in FIG. 2, four developing devices 2*a*, 2*b*, 2*c*, and 2*d*, four photosensitive drums 3*a*, 3*b*, 3*c*, and 3*d*, four electrifying devices 5*a*, 5*b*, 5*c*, and 5*d*, and four cleaner units 4*a*, 4*b*, 4*c*, and 4*d* are provided for forming four different latent images corresponding to respective colors (K, C, M, and Y). Then, these members compose image stations Sa, Sb, Sc, and Sd corresponding to respective colors (K, C, M, and Y). Note that the reference letter "a" corresponds to black (black color), the reference letter "b" corresponds to cyan (chromatic color), the reference letter "c" corresponds to magenta (chromatic color), and the reference letter "d" corresponds to yellow (chromatic color). Moreover, the image stations Sa, Sb, Sc, and Sd have substantially the same configuration.

The photosensitive drums 3*a* to 3*d* are provided at an upper area of the image forming apparatus. Around the photosensitive drum 3*a* (3*b*, 3*c*, 3*d*), the electrifying device 5*a* (5*b*, 5*c*, 5*d*), the developing device 2*a* (2*b*, 2*c*, 2*d*), and the cleaner unit 4*a* (4*b*, 4*c*, 4*d*) are provided along a rotation direction (shown by an arrow A in FIG. 3) of the photosensitive drum 3*a* (3*b*, 3*c*, 3*d*).

The electrifying device 5*a* (5*b*, 5*c*, 5*d*) is electrifying means for electrifying the surface of the photosensitive drum 3*a* (3*b*, 3*c*, 3*d*) uniformly at a predetermined potential. A scorotron electrifying device having a case for covering a saw-tooth discharge electrode, a mesh grid, and a mesh discharge electrode is used as the electrifying device 5*a* (5*b*, 5*c*, 5*d*). In this example, the image station Sa (black (K)) includes the electrifying device 5*a*, the image station Sb (cyan (C)) includes the electrifying device 5*b*, the image station Sc (magenta (M)) includes the electrifying device 5*c*, and the image station Sd (yellow (Y)) includes the electrifying device 5*d*.

Here, the electrifying devices 5*a* (black (K)), 5*b* (cyan (C)), 5*c* (magenta (M)), and 5*d* (yellow (Y)) have the same shape and each have the width of 14 mm (a width in a direction substantially perpendicular to a direction in which the rotation axis of the photosensitive drum (3*a* to 3*d*) extends). Further, the shapes and specs of the electrifying devices 5*a* to 5*d* are standardized so that the electrifying devices 5*a* to 5*d* can be used in the other image forming apparatus whose processing speed is different from the present image forming apparatus.

Moreover, to the electrifying device 5*a* (5*b*, 5*c*, 5*d*) in the image station Sa (Sb, Sc, Sd), high electric power is supplied from a high power source (not shown) provided for each electrifying device (5*a*, 5*b*, 5*c*, 5*d*). An on-off operation of high output from the high power source to the electrifying device (5*a*, 5*b*, 5*c*, 5*d*) is controlled by the switching of a low-tension primary side of the high power source.

A contact-type electrifying device, such as a roller electrifying device and a brush electrifying device, can be used as the electrifying device (5*a*, 5*b*, 5*c*, 5*d*).

The exposure unit 1 has a function of exposing the photosensitive drums 3*a* to 3*d*, respectively electrified by the electrifying devices 5*a* to 5*d*, in accordance with the input image data, so as to form electrostatic latent images respectively on the surfaces of the photosensitive drums 3*a* to 3*d*. Used as the exposure unit 1 is a laser scanning unit (LSU) including a laser irradiating section 1*a* and a reflection mirror 1*b*. Note that a device in which light emitting elements are arranged in an array, such as an EL or an LED write head, can also be used as the exposure unit 1.

The developing device 2*a* (2*b*, 2*c*, 2*d*) visualizes with K (C, M, Y) toner the electrostatic latent image formed on the photosensitive drum 3*a* (3*b*, 3*c*, 3*d*).

The cleaner unit 4*a* (4*b*, 4*c*, 4*d*) includes the cleaner blade 4Ba (4Bb, 4Bc, 4Bd), and is in contact with the photosensitive drum 3*a* (3*b*, 3*c*, 3*d*) so as to remove and collect the toner remaining on the surface of the photosensitive drum 3*a* (3*b*, 3*c*, 3*d*) after the development and/or the image transfer.

The intermediate transfer belt unit 8 is provided above the photosensitive drums 3*a* to 3*d*. The intermediate transfer belt unit 8 includes intermediate transfer rollers 6*a* to 6*d*, an intermediate transfer belt 7, an intermediate transfer belt drive roller 71, an intermediate transfer belt driven roller 72, an intermediate transfer belt tension mechanism 73, and an intermediate transfer belt cleaning unit 9. The intermediate transfer rollers 6*a* to 6*d*, the intermediate transfer belt drive roller 71, the intermediate transfer belt driven roller 72, the intermediate transfer belt tension mechanism 73, etc. causes the intermediate transfer belt 7 to extend and causes the intermediate transfer belt 7 to rotate in a direction shown by an arrow B in FIG. 3.

The intermediate transfer rollers 6*a* to 6*d* are rotatably supported by an intermediate transfer roller attachment section (not shown) of the intermediate transfer belt tension mechanism 73 of the intermediate transfer belt unit 8. The intermediate transfer rollers 6*a* to 6*d* supply a transfer bias for transferring onto the intermediate transfer belt 7 the toner images on the photosensitive drums 3*a* to 3*d*.

The intermediate transfer belt 7 is provided so as to be in contact with the photosensitive drums 3*a* to 3*d*. The K, C, M, and Y toner images formed respectively on the photosensitive drums 3*a*, 3*b*, 3*c*, and 3*d* are sequentially transferred onto the intermediate transfer belt 7 in an overlapping manner, and thus the color toner image (multicolor toner image) is formed on the intermediate transfer belt 7. The intermediate transfer belt 7 is an endless belt and is formed by using a film having the thickness of about 100 μm to 150 μm. Note that in the case of carrying out a black-and-white printing, only the photosensitive drum 3*a* (black (K)) is in contact with the intermediate transfer belt 7.

Moreover, the intermediate transfer belt 7 can separate from the photosensitive drums 3*a* to 3*d*. Specifically, in the intermediate transfer belt unit 8, the intermediate transfer belt 7 can separate from the photosensitive drums 3*a* to 3*d* by changing, by drive means (not shown), relative positions of the intermediate transfer rollers 6*a* to 6*d*, the intermediate transfer belt drive roller 71, the intermediate transfer belt driven roller 72, the intermediate transfer belt tension mechanism 73, etc.

The transfer of the toner images from the photosensitive drums 3*a* to 3*d* onto the intermediate transfer belt 7 is carried out by the intermediate transfer rollers 6*a* to 6*d* which are in contact with the back surface of the intermediate transfer belt 7. For transferring the toner images, the high voltage transfer bias (a high voltage having a polarity (+) opposite to the polarity (−) of the toner electrified) is applied to the intermediate transfer rollers 6*a* to 6*d*.

The intermediate transfer roller (6*a*, 6*b*, 6*c*, and 6*d*) is formed by covering, with a conductive elastic material (for example, EPDM, expanded urethane, etc.), the surface of a metal (for example, stainless steel) shaft having the diameter of 8 mm to 10 mm. Because of this conductive elastic material, the intermediate transfer roller (6*a*, 6*b*, 6*c*, and 6*d*) can apply the high voltage uniformly to the intermediate transfer belt 7. In this example, the intermediate transfer roller (6*a*, 6*b*, 6*c*, and 6*d*) is used as the transfer electrode, however a brush can also be used.

As above, the electrostatic images (respective color toner images) visualized on the photosensitive drums 3*a* to 3*d* are transferred onto (stacked on) the intermediate transfer belt 7, and thus becomes an image corresponding to image information supplied to the image forming apparatus 100. The image thus transferred (stacked) is conveyed to a contacting position of a recording sheet (will be described later) and the intermediate transfer belt 7 by the rotation of the intermediate transfer belt 7, and then the image is transferred onto the recording sheet by a transfer roller 11 provided at this contacting position.

Here, the intermediate transfer belt 7 and the transfer roller 11 are in contact with each other by a predetermined nip (a predetermined pressure and a predetermined nip width), and a voltage (a high voltage having a polarity (+) opposite to the polarity (−) of the toner electrified) for causing the toner to transfer onto the recording sheet is applied to the transfer roller 11. In order that the transfer roller 11 constantly keep the above-described nip, it is preferable that one of the transfer roller 11 and the intermediate transfer belt drive roller 71 be made of a hard material (metal, etc.), and another one be made of a soft material (for example, an elastic roller, an elastic rubber roller, a resin foam roller, etc.).

Moreover, as described above, the toner adhered to the intermediate transfer belt 7 by the contact of the intermediate transfer belt 7 with the photosensitive drums 3*a* to 3*d* or the toner remaining on the intermediate transfer belt 7 since the toner is not transferred onto the recording sheet by the transfer roller 11 is a cause of an occurrence of a color mixture of the toner in the following process. Therefore, the above-described toner is removed and collected by the intermediate transfer belt cleaning unit 9.

The intermediate transfer belt cleaning unit 9 includes, for example, a cleaning blade as a member (a cleaning member) which is in contact with the intermediate transfer belt 7. In this case, at a position where the cleaning blade is in contact with the intermediate transfer belt 7, the back surface of the intermediate transfer belt 7 is supported by the intermediate transfer belt driven roller 72.

The paper feed tray 10 is a tray for storing the recording sheets (recording papers) used for image formation, and is provided under the exposure unit 1 of the image forming apparatus 100. The paper receiving tray 15 provided at an upper area of the image forming apparatus 100 is a tray for receiving the printed recording sheets (face down). A manual paper feed tray 20 is foldably provided on the side wall of the image forming apparatus 100, and is a tray for manual feeding of the recording sheets at the side of the image forming apparatus 100.

Moreover, the image forming apparatus 100 includes the paper conveyance path S that is substantially a vertical form and allows the recording sheet to be fed from the paper feed tray 10 through the transfer roller (transfer section) 11 and the fixing unit 12 to the paper receiving tray 15. Further, in the vicinity of the paper conveyance path S leading from the paper feed tray 10 and from the manual paper feed tray 20 to the paper receiving tray 15, pickup rollers 16 and 17, a resist roller 14, the transfer roller 11, the fixing unit 12, conveying rollers 21 to 28 for conveying the recording sheet, etc. are provided.

The conveying rollers 21 to 26 are small rollers used for facilitating and supporting the conveyance of the recording sheet, and are provided along the paper conveyance path S. The conveying rollers 27 and 28 are rollers used for carrying out the two-sided printing. To turn over the recording sheet onto one surface of which an image is transferred, the conveying rollers 27 and 28 conveys the recording sheet from a reverse paper output path of the paper conveyance path S to the resist roller 14. The reverse paper output path is provided next to the fixing unit 12.

The pickup roller 16 is provided close to an edge portion (at which the recording sheet is picked up) of the paper feed tray 10, and the pickup roller 17 is provided close to an edge portion (at which the recording sheet is picked up) of the manual paper feed tray 20. The pickup roller 16 is a roller which picks up the recording sheets one-by-one from the paper feed tray 10 and supplies to the paper conveyance path S. The pickup roller 17 is a roller which picks up the recording sheets one-by-one from the manual paper feed tray 20 and then supplies the recording sheet to the paper conveyance path S.

The resist roller 14 is a roller which once holds the recording sheet which is conveyed in the paper conveyance path S. The resist roller 14 restarts conveying the recording sheet at such a timing that the top edge of the toner image on the intermediate transfer belt 7 meets the top edge of the recording sheet.

The fixing unit 12 includes a heat roller 12*a*, a pressure roller 12*b*, etc. The heat roller 12*a* and the pressure roller 12*b* rotate while sandwiching the recording sheet.

Moreover, the heat roller 12*a* is set so as to have a predetermined fixation temperature in accordance with a control based on a signal from a temperature detecting device (not shown). Together with the pressure roller 12*b*, the heat roller 12*a* carries out thermocompression bonding with respect to the recording sheet. Thus, the toner image (a multicolor toner image or a single color toner image) transferred onto the recording sheet is melted, mixed, pressed, and fixed by heat on the recording sheet.

The recording sheet on which the multicolor toner image is fixed is conveyed by the conveying rollers 22 and 23 to the reverse paper output path of the paper conveyance path S. Thus, this recording sheet is output face-down to the paper receiving tray 15 (the surface on which the toner image is formed faces the downward direction).

The image forming apparatus 100 of the present embodiment uses a developer (two component developer) which is formed by agitating magnetic powder carrier and nonmagnetic powder carrier so that this mixture is electrified by friction and the magnetic power carrier and the nonmagnetic powder carrier are electrostatically attracted to each other.

Figure 3:
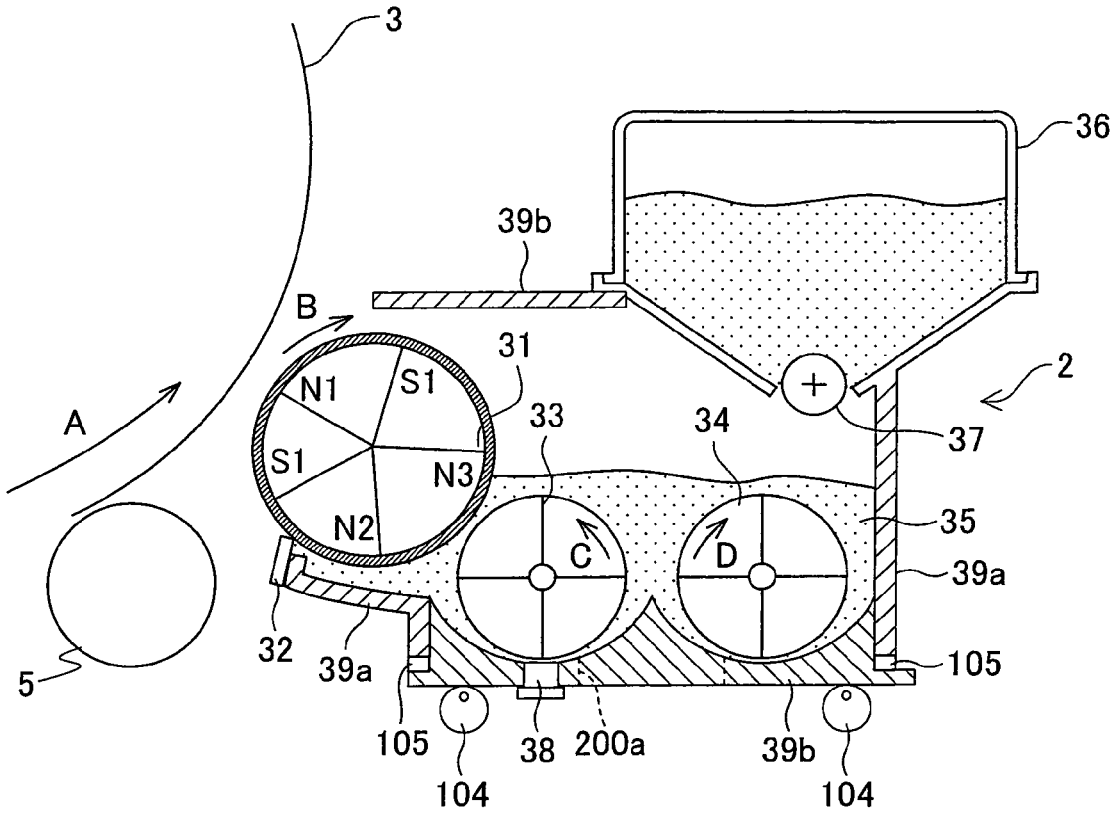
FIG. 3 is an explanatory diagram schematically showing the relation among a photosensitive drum, an electrifying device, and a developing device, in the image forming apparatus including the waste developer collecting device of one embodiment.

FIG. 3 is a cross-sectional diagram schematically showing the relation among the photosensitive drum 3, the electrifying device 5, and the developing device 2, in the image forming apparatus 100. As described above, the photosensitive drums 3*a* to 3*d* have substantially the same configuration. Therefore, in the present specification, when explaining a configuration which is common among the photosensitive drums 3*a* to 3*d*, the photosensitive drums 3*a* to 3*d* are collectively called the photosensitive drum 3. Similarly, when explaining a configuration which is common among the developing devices 2*a* to 2*d*, the developing devices 2*a* to 2*d* are collectively called the developing device 2. Further, when explaining a configuration which is common among the electrifying devices 5*a* to 5*d*, the electrifying devices 5*a* to 5*d* are collectively called the electrifying device 5.

As shown in FIG. 3, the developing device 2 includes a developing sleeve (developing roller) 31, a doctor blade 32, conveying screws 33 and 34, a developer tank 35, a toner supply tank 36, a toner supply screw 37, and a developer concentration sensor (toner concentration sensor) 38.

The developer tank 35 is a tank for storing the developer, and includes a fixed housing portion 39*a* and a movable housing portion 39*b*.

The movable housing portion 39*b* is a bottom portion of the developer tank 35, and can move upwardly and downwardly. Specifically, a plurality of eccentric cams 104 (for example, three eccentric cams 104) are provided under the movable housing portion 39*b*. The eccentric cams 104 are rotated by a movable housing portion driving motor (see FIG. 11). By the rotation of the eccentric cams 104, the movable housing portion 39 moves upwardly or downwardly. This realizes switching or adjustment of a gap between the movable housing portion 39*b* and the conveying screw (33, 34). Note that the image forming apparatus 100 includes a developer discharge control section (control section) 40 for controlling the operation of the developing device 2 when discharging the waste developer, and the developer discharge control section 40 controls the moving-up and moving-down of the movable housing portion 39*b*.

Moreover, a developer discharge opening 200*a* is formed with respect to the movable housing portion 39*b*. Further, a discharge opening shutter 210 and a collecting container attachment portion 220 are provided at a lower area of the developing device 2, and collecting containers 300A and 300B are provided under the developing device 2. These members configure a waste developer collecting device 50 (see FIG. 1, etc.). Moreover, a developer concentration sensor (toner concentration sensor, detecting section) 38 is provided below the bottom surface of the developer tank 35 so as to face the conveying screw 33 provided above the bottom surface of the developer tank 35.

A sealant 105 is provided between the movable housing portion 39*b* and the fixed housing portion 39*a* so that the developer does not leak to the outside of the developer tank 35. The material of the sealant 105 is not especially limited as long as the sealant 105 can appropriately prevent the developer from leaking even if the movable housing portion 39*b* changes its position. As the sealant 105, it is possible to use, for example, urethane foam including therein a large number of independent bubbles.

The fixed housing portion 39*a* has an opening portion. Through this opening portion, the developer is supplied from the toner supply tank 36. The toner supply tank 36 includes the toner supply screw 37. By the rotation of this toner supply screw 37, a predetermined amount of toner is supplied from the toner supply tank 36 to the developer tank 35. In the image forming apparatus 100, a toner supply control section (not shown) controls the rotation of the toner supply screw 37 on the basis of a result of the detection carried out by the developer concentration sensor 38. Thus, the amount of toner supplied to the developer tank is controlled. Moreover, the developer concentration sensor has another function of detecting the liquid level of the developer in the developer tank 35 on the basis of a result of the detection of the developer concentration.

The conveying screws (agitating screw) 33 and 34 agitate the developer in the developer tank 35 so as to slightly electrify the developer and so as to convey the developer to the developing sleeve 31. When discharging the developer, the conveying screws 33 and 34 drive (idle) so that the developer is conveyed to the developer discharge opening 200*a* and discharged.

Figure 4:
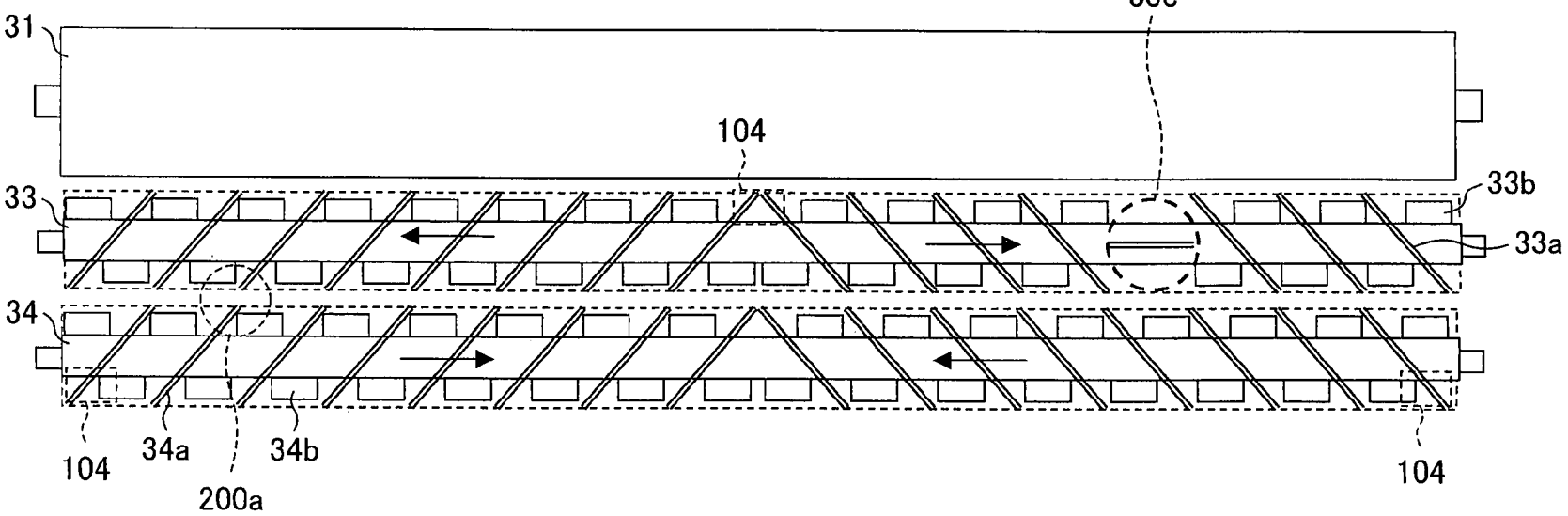
FIG. 4 is a plan view (viewed from above) of a developing sleeve and conveying screws included in the developing device of the waste developer collecting device of one embodiment.

FIG. 4 is a plan view (viewed from above) of the developing sleeve 31 and the conveying screws 33 and 34. As shown in FIG. 4, a large number of elliptic ribs (stirring wings) 33*a* and rectangular ribs (stirring wings, rectangular ribs) 33*b* are provided on the surfaces of the conveying screw 33, and a large number of elliptic ribs (agitating wings) 34*a* and rectangular ribs (agitating wings, rectangular ribs) 34*b* are provided on the surfaces of the conveying screw 34.

Each elliptic rib 33*a* (34*a*) is provided not in parallel with and not perpendicular to a direction in which the rotation axis of the conveying screw 33 (34) extends. In addition, the elliptic ribs 33*a* (34*a*) are axisymmetrical about a plane (symmetry plane) perpendicular to the rotation axis located at substantially a center, in a direction in which the conveying screw 33 (34) extends, of the conveying screw 33 (34). Moreover, the elliptic ribs 34*a* are provided so that the developer is conveyed by the rotation of the conveying screw 34 toward the center of the conveying screw 34 in a direction in which the conveying screw 34 extends. Moreover, the elliptic ribs 33*a* are provided so that the developer is conveyed by the rotation of the conveying screw 33 toward both ends, in a direction in which the conveying screw 33 extends, of the conveying screw 33. Note that as shown by arrows C and D in FIG. 3, the rotation direction of the conveying screw 33 and the rotation direction of the conveying screw 34 are opposite to each other.

The rectangular rib 33*b* (34*b*) is provided between the elliptic ribs 33*a* (34*a*). By the rotation of the conveying screw 33 (34), the rectangular rib 33*b* (34*b*) conveys the developer in a direction substantially perpendicular to a direction in which the rotation axis of the conveying screw 33 (34) extends.

Moreover, on the conveying screw 33, a cutout portion 33*c* from which the elliptic ribs 33*a* and the rectangular ribs 33*b* are removed is formed at a position facing the developer concentration sensor 38. That is, the elliptic ribs 33*a* and the rectangular ribs 33*b* are not provided at a position, on the conveying screw 33, facing the developer concentration sensor 38. Therefore, the developer concentration sensor 38 does not cause ripples (false detections) caused due to the passing of each rib.

As shown by dotted lines in FIG. 4, the developer discharge opening 200*a* and the eccentric cams 104 are provided under the conveying screws 33 and 34. Note that three eccentric cams 104 are provided under the movable housing portion 39*b*, that is, the movable housing portion 39*b* is supported by three points.

The doctor blade 32 is provided such that a doctor gap is set to a predetermined value. Note that the doctor gap is a gap between the developing sleeve 31 and the top edge of the doctor blade 32. The doctor blade 32 is provided for removing some of the toner adhered to the developing sleeve 31. The doctor blade 32 is provided upstream of a nip portion of the developing sleeve 31 and the photosensitive drum 3 (upstream of the nip portion in a rotation direction of the developing sleeve 31).

The developing sleeve 31 takes up the developer from the developer tank 35, and conveys the developer to the surface of the photosensitive drum 3 (or to a surface facing the photosensitive drum 3). That is, the developing device 2 of the present embodiment is a developing device using a take-up development method.

The developing sleeve 31 is in the form of a cylinder which is rotatable. Part of the outer peripheral surface of the developing sleeve 31 is exposed from the aperture portion of the developer tank 35 so that the part of the outer peripheral surface of the developing sleeve 31 faces the photosensitive drum 3. Moreover, the developing sleeve 31 includes therein a fixed magnet which is a combination of a plurality of magnets having different magnetism. The fixed magnet in the developing sleeve 31 includes a conveyance start pole N2, a conveyance pole S1, a developer supplying pole N1, a conveyance pole S2, and a removing pole N3. Note that the conveyance start pole N2, the conveyance pole S1, the developer supplying pole N1, the conveyance pole S2, and the removing pole N3 are provided close to the outer peripheral surface of the developing device 31, and are provided along a rotation direction (shown by the arrow B in FIG. 3) of the developing device 32.

Note that at least part of the conveyance start pole N2 is provided below the liquid surface of the developer (the liquid surface of the developer before carrying out a developer discharging process) which is stored in the developer tank 35 and the amount of which is an amount necessary for safely developing an electrostatic latent image formed on the photosensitive drum 3. Thus, the developing sleeve 31 is provided below the liquid surface of the developer, takes up the developer, and then conveys the developer, the amount of which is an amount before carrying out the developer discharging process.

The photosensitive drum 3 is provided so as to face the developer supplying pole N1 of the developing sleeve 31, and the conveying screw 34 is provided so as to face the removing pole N3 of the developing sleeve 31. Moreover, the doctor blade 32 is provided so as to face substantially a position between the conveyance start pole N2 and the conveyance pole S1.

Moreover, the photosensitive drum 3 is provided so as to be rotatable by driving means, such as a motor (not shown), and the developing sleeve 31 is provided so as to be rotatable by driving means, such as a motor (not shown). Moreover, while an image is being formed (when developing the electrostatic latent image formed on the photosensitive drum 3), the peripheral speed of the developing sleeve 31 is set to be 1.3 times to 2.5 times faster than the peripheral speed of the photosensitive drum 3.

[Waste Developer Collecting Device 50]

The following will explain the waste developer collecting device 50 included in the image forming apparatus 100.

First, the configuration of the waste developer collecting device 50 is explained. Note that the waste developer collecting device 50 includes the developing devices 2, and the collecting containers 300A and 300B shown in FIG. 1. In the following explanation, if a member in the collecting container 300A has the same function as a member in the collecting container 300B, the same reference numeral is used for these members.

Figure 1:
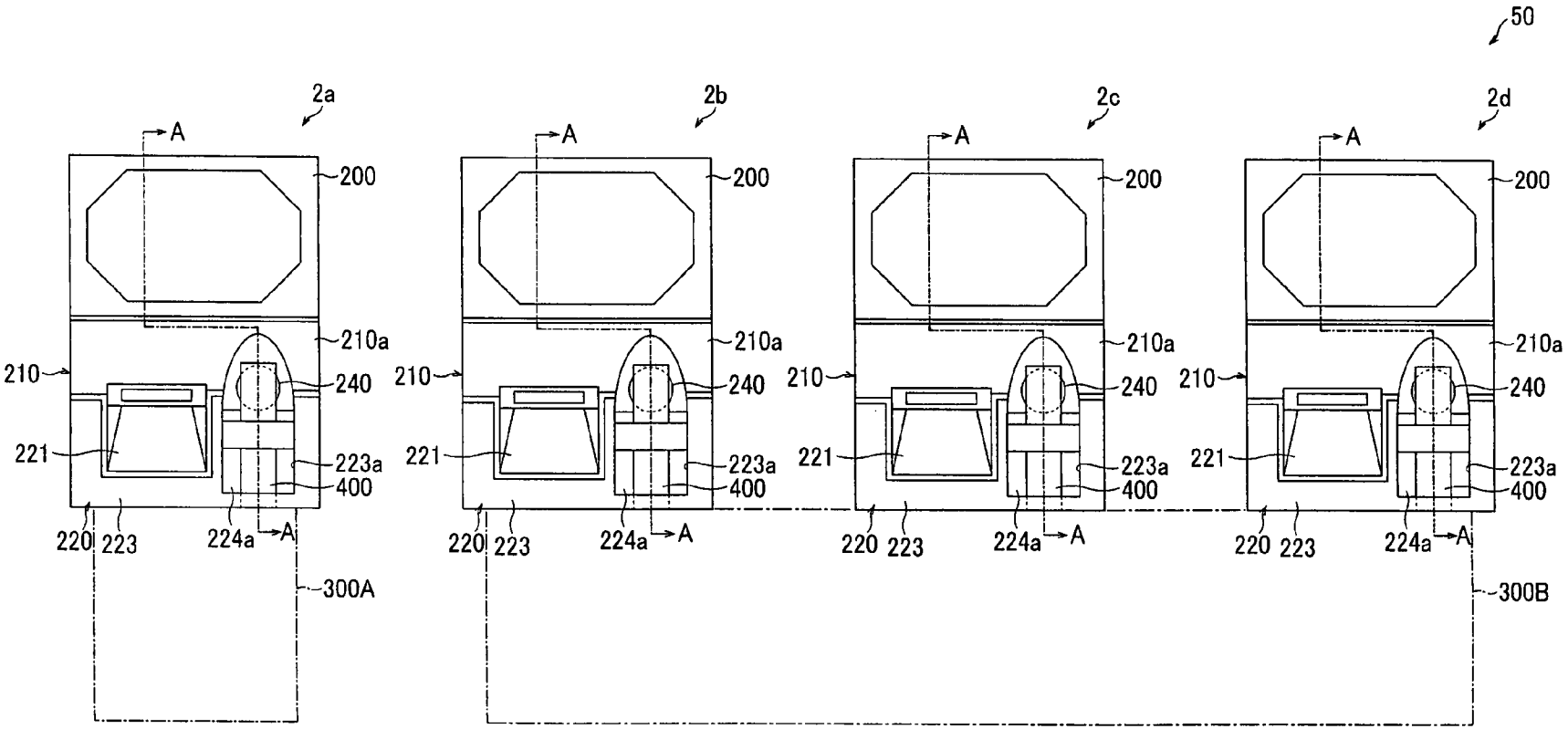
FIG. 1 is a front view showing an appearance of a waste developer collecting device of one embodiment.
Figure 5:
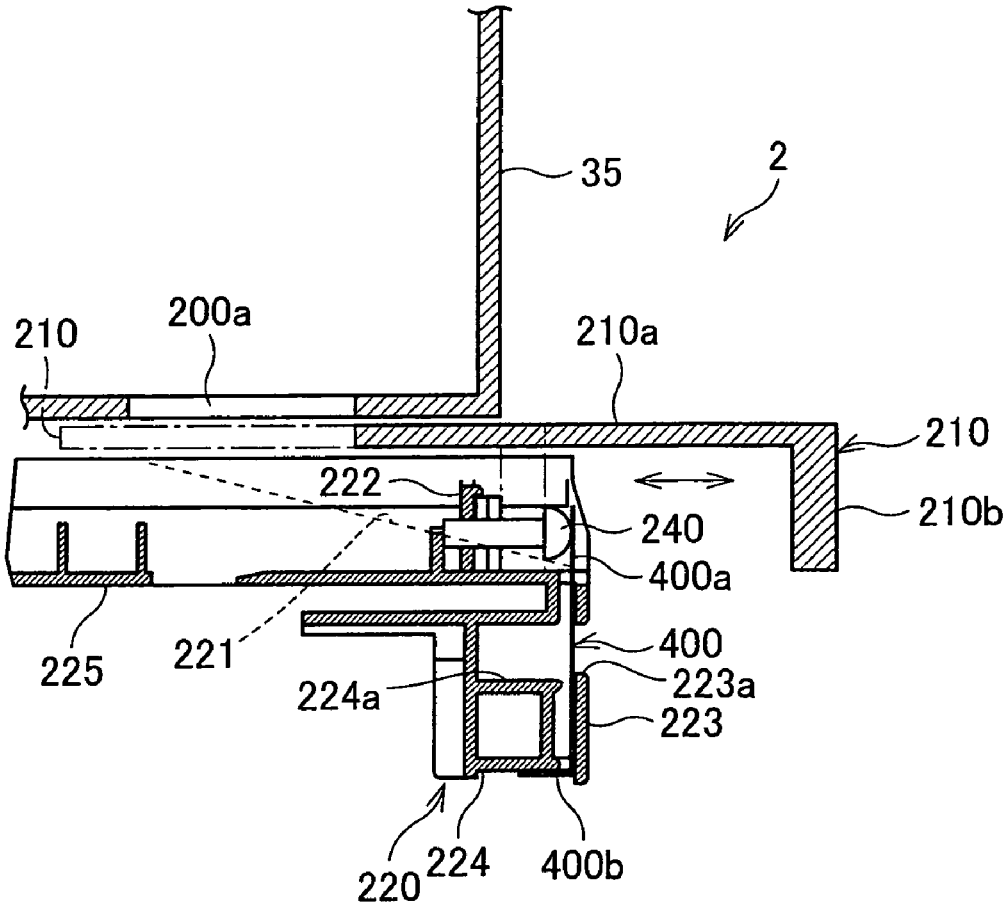
FIG. 5 is a cross-sectional view taken along the line A-A of the developing device shown in FIG. 1.

FIG. 1 is a front view showing an appearance of the developing device 2 (the waste developer collecting device 50). FIG. 1 shows a front surface of the developing device 2. The expression "front surface" as used herein is a surface to which a user faces for operations. A cover is provided on the front surface of the image forming apparatus 100. When this cover is opened for maintenance, etc., the developing device 2 appears. FIG. 5 is a cross-sectional view taken along the line A-A of FIG. 1.

As shown in FIG. 1, the waste developer collecting device 50 includes (i) the collecting container 300A for collecting the developer discharged from the developing device 2*a* (black (K)), and (ii) the collecting container 300B for collecting the developers discharged from the developing devices 2*b* (cyan (C)), 2*c* (magenta (M)), and 2*d* (yellow (Y)). That is, in the waste developer collecting device 50, the cyan (C), magenta (M), and yellow (Y) developers are collected by the collecting container 300B.

As shown in FIGS. 1 and 5, the discharge opening shutter 210 and the collecting container attachment portion 220 are provided under the developer tank 35 (the movable housing portion 39*b*) of the developing device 2.

The discharge opening shutter 210 is open-close means, and includes a horizontal portion 210*a* and a front surface portion 210*b*. The discharge opening shutter 210 can be pulled out and pushed in directions shown by an arrow in FIG. 5.

The horizontal portion 210*a* is in the form of a plate which extends in a horizontal direction. When the developing device 2 is used as usual (when forming an image), the horizontal portion 210*a* is provided at such a position (shown by a chain line in FIG. 5) that the developer discharge opening 200*a* is sealed and the developer does not leak. The developer discharge opening 200*a* is formed on the bottom surface (the movable housing portion 39*b*) of the developer tank 35, in other words, the developer discharge opening 200*a* is formed on the bottom surface of the developing device 2 and close to the front surface of the developing device 2. Therefore, since the developer discharge opening 200*a* is provided close to the collecting containers 300A and 300B (will be described later), the inclination of a discharging slope 221 (will be described later) can be made steeper, and the discharging of the developer can be made easier.

The front surface portion 210*b* is provided on a side of the front surface of the developing device 2, and extends perpendicular to the horizontal portion 210*a* and downwardly from the horizontal portion 210*a*. The lower edge of the front surface portion 210*b* locates slightly above an opening portion 223*a* of a front surface wall portion (opening wall portion) 223 (will be described later). Thus, the front surface portion 210*b* does not cover the opening portion 223*a*.

The collecting container attachment portion 220 is collecting container fixation means (collecting container fixing section). The collecting container attachment portion 220 is a portion of the developing device 2, and locates below the horizontal portion 210*a*, that is, locates in a lower area of the developing device 2. The collecting container attachment portion 220 includes the discharging slope 221, a discharge opening shutter holding portion 222, the front surface wall portion 223, a collecting container holding portion 224, and a base portion 225.

The base portion 225 is provided so as to be in parallel with the bottom surface of the developing device 2, and is provided between the bottom surface of the developing device 2 and the horizontal portion 210*a*. Although not shown, the base portion 225 is fixed to the developing device 2.

The discharging slope 221 is provided above the base portion 225. The discharging slope 221 includes an inclined surface which extends from a backmost edge portion of the developer discharge opening 200*a* to the front surface of the collecting container attachment portion 220. Moreover, the discharging slope 221 is a path for guiding the waste developer from the developer discharge opening 200*a* to the outside of the developing device 2. When the discharge opening shutter 210 closes the developer discharge opening 200*a* (when the discharge opening shutter 210 is at a position shown by the chain line in FIG. 5), an opening edge portion (on a side of the front surface) of the discharging slope 221 is covered by the front surface portion 210*b*.

The discharge opening shutter holding portion 222 is provided on the base portion 225, and has a hole (not shown) into which a fixation screw 240 is screwed. Note that the fixation screw 240 is fixation means (fixation section). The fixation screw is fixed to the discharge opening shutter holding portion 222 while the head of the fixation screw 240 holds the front surface portion 210*b*. Thus, the discharge opening shutter 210 is fixed to the collecting container attachment portion 220 while the discharge opening shutter 210 closes the developer discharge opening 200*a*.

The front surface wall portion 223 is formed slightly below the opening edge portion of the discharging slope 221. The front surface wall portion 223 has the opening portion 223*a* into which a top edge portion 302*a* (see FIGS. 6 to 8) of a nail portion 302 of the collecting container 300A or 300B is inserted. The opening portion 223*a* of the front surface wall portion 223 locates next to the opening edge portion of the discharging slope 221. Thus, the opening portion 223*a* and the opening edge portion of the discharging slope 221 are provided by side, so that it is possible to prevent the collecting container attachment portion 220 from becoming large downwardly.

The collecting container holding portion 224 is provided downwardly from the lower edge of the base portion 225, and there is a predetermined distance (gap) between the collecting container holding portion 224 and the front surface wall portion 223. The collecting container holding portion 224 has a recess portion 224*a* at a position close to the opening portion 223*a*.

Figure 9:
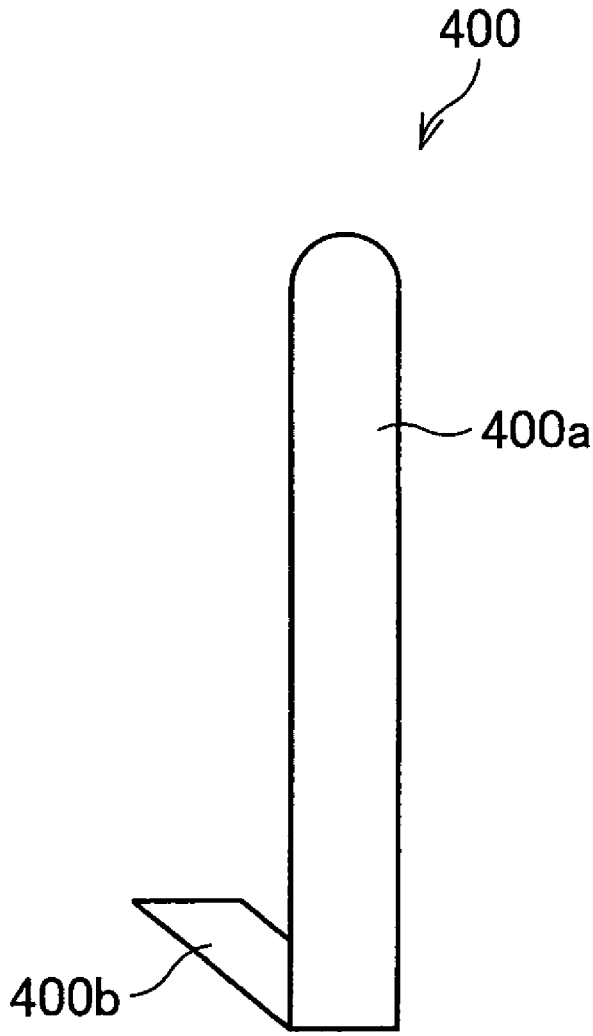
FIG. 9 a perspective view showing a configuration of a screw shielding member included in the waste developer collecting device of one embodiment.

A screw shielding member 400 is inserted into the gap between the collecting container holding portion 224 and the front surface wall portion 223, and locates behind the opening portion 223*a*. As shown in FIG. 9, the screw shielding member 400 that is means for allowing fixing and unfixing includes a main body portion 400*a* and a fixation portion 400*b*. Note that the main body portion 400*a* is long and thin, and the fixation portion 400*b* extends from the lower edge portion of the main body portion 400*a* in a direction perpendicular to the main body portion 400*a*. The main body portion 400*a* extends linearly, the upper edge portion of the main body portion 400*a* is provided so as to cover the head of the fixation screw 240, and the main body portion 400*a* is exposed from the front surface wall portion 223. Thus, the screw shielding member 400 shields the head of the fixation screw 240 with the nail portion 302 not inserted into the opening portion 223*a*. Moreover, the fixation portion 400*b* is fixed to the lower edge surface of the collecting container holding portion 224. It is desirable that the screw shielding member 400 that is a flexible member be made of a flexible material, such as a polyethylene terephthalate film (for example, Mylar (product name) produced by DuPont), be thin (for example, a film having the thickness of about 0.1 mm to 0.3 mm), and be easily deformed by an external force.

Figure 6:
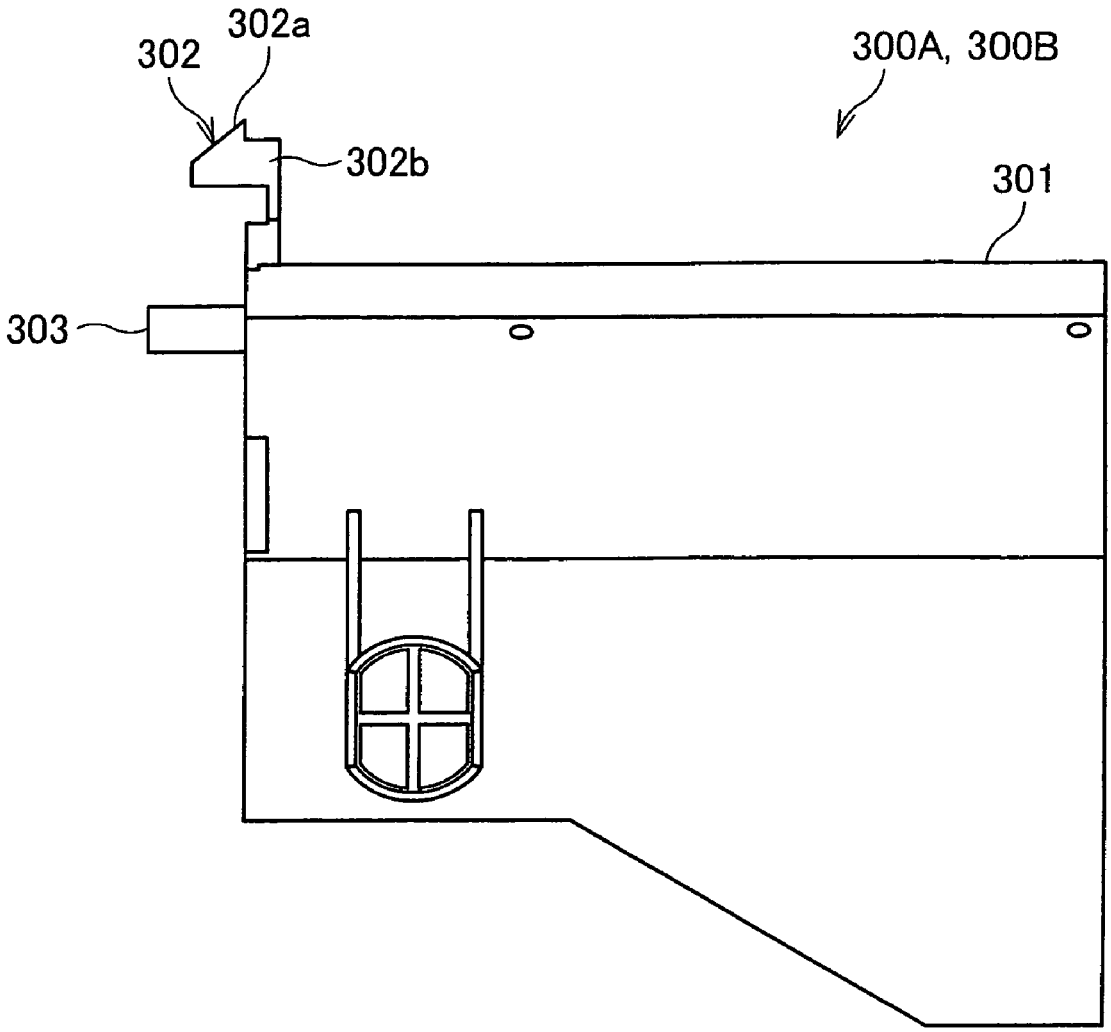
FIG. 6 is a side view showing a configuration of a collecting container included in the waste developer collecting device of one embodiment.
Figure 7:
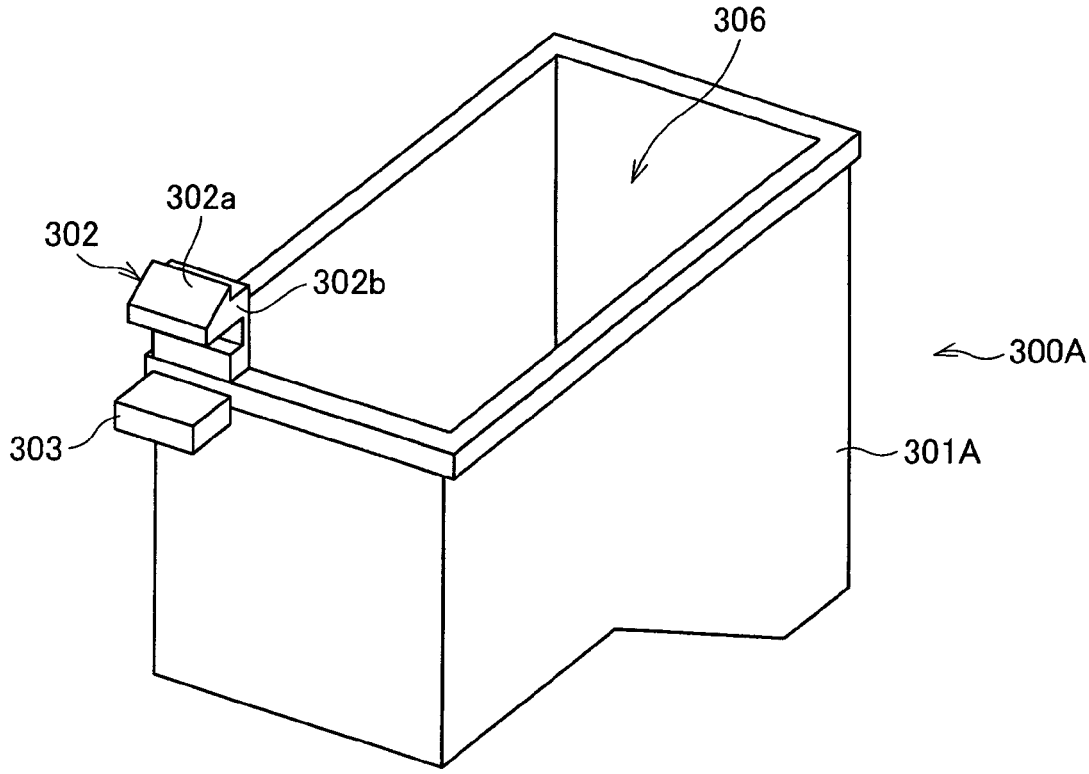
FIG. 7 is a perspective view showing a configuration of a collecting container included in the waste developer collecting device of one embodiment.
Figure 8:
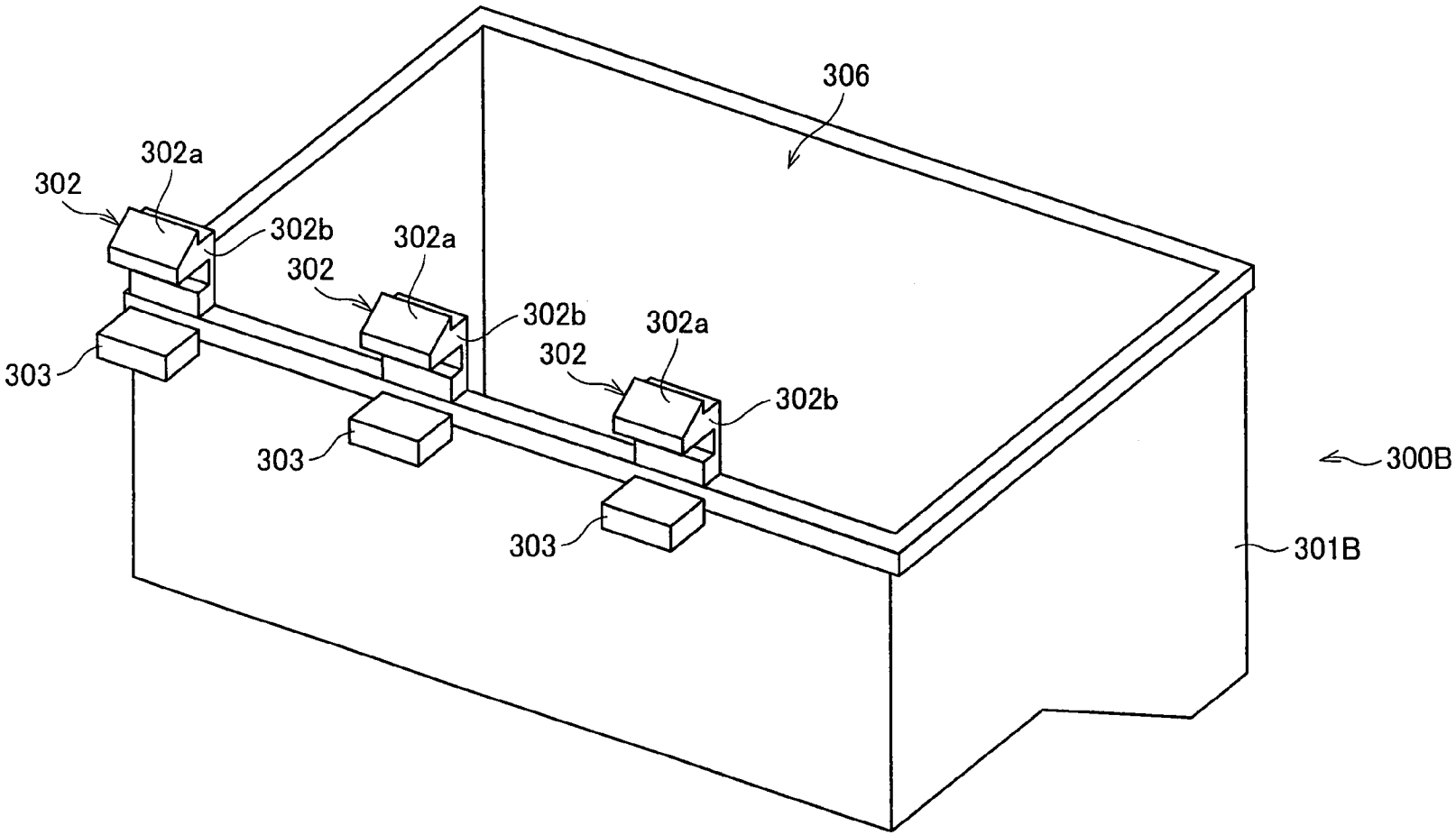
FIG. 8 is a perspective view showing a configuration of a collecting container included in the waste developer collecting device of one embodiment.

FIG. 6 is a side view showing the configuration of the collecting container (300A, 300B), FIG. 7 is a perspective view showing the configuration of the collecting container 300A, and FIG. 8 is a perspective view showing the configuration of the collecting container 300B.

As shown in FIGS. 6 to 8, the collecting container 300A includes a container main body 301A, and the collecting container 300B includes a container main body 301B. Each of the container main body 301A and the container main body 301B includes a collecting tank 306 which is in the form of an upwardly opening box for collecting the waste developer. Moreover, in each of the container main body 301A and the container main body 301B, the nail portion 302 and a contacting portion 303 are provided at the upper edge portion of the side surface (a side surface of the container main body (301A, 301B)) which is in contact with the collecting container attachment portion 220 included in the developing device 2. That is, in each of the container main body 301A and the container main body 301B, the nail portion 302 and a contacting portion 303 are provided at a position corresponding to the collecting container attachment portion 220 of the developing device 2.

The nail portion 302 is a container joint portion, and includes the top edge portion 302*a* and a supporting portion 302*b*. With the collecting container (300A, 300B) attached to the collecting container attachment portion 220 and fixed below the developing device 2 as shown in FIG. 1, the top edge portion 302*a* is locked in (connected to) the opening portion 223*a* that is a fixation joint portion, and is formed at such a position that the waste developer discharged from the discharging slope 221 can pass through the side of the top edge portion 302*a*. Moreover, in order that the top edge portion 302*a* is locked by the peripheral rim of the opening portion 223*a* formed on an inner edge surface of the front surface wall portion 223, the top edge portion 302*a* is in the form of a hook (a projection) whose upper edge portion projects. Moreover, the top edge portion 302*a* has an inclined surface at its front edge so that the top edge portion 302*a* can be easily inserted into the opening portion 223*a*. Further, the nail portion 302 has moderate flexibility so that the top edge portion 302*a* can be easily inserted into and taken out from the opening portion 223*a* and the collecting containers 300A and 300B are held tightly.

The supporting portion 302*b* includes (i) a horizontal portion which extends horizontally from the top edge portion 302*a* and (ii) a vertical portion which extends downwardly from the horizontal portion. The horizontal portion has such a thickness (a cross-section shape) that the horizontal portion can be inserted into the opening portion 223*a*.

Since the nail portion 302 has the above-described shape, the nail portion 302 has a function of pressing the screw shielding member 400 into the recess portion 224*a* and a function of fixing the collecting container (300A, 300B) to the collecting container attachment portions 220. This improves the attachment of the collecting container (300A, 300B) to a main body of the image forming apparatus 100, prevents the collecting container (300A, 300B) from falling down from the main body of the image forming apparatus 100 by the weight of the collecting container (300A, 300B), and prevents the collecting container (300A, 300B) from falling down from the main body of the image forming apparatus 100 by the weight of the developer.

Figure 10:
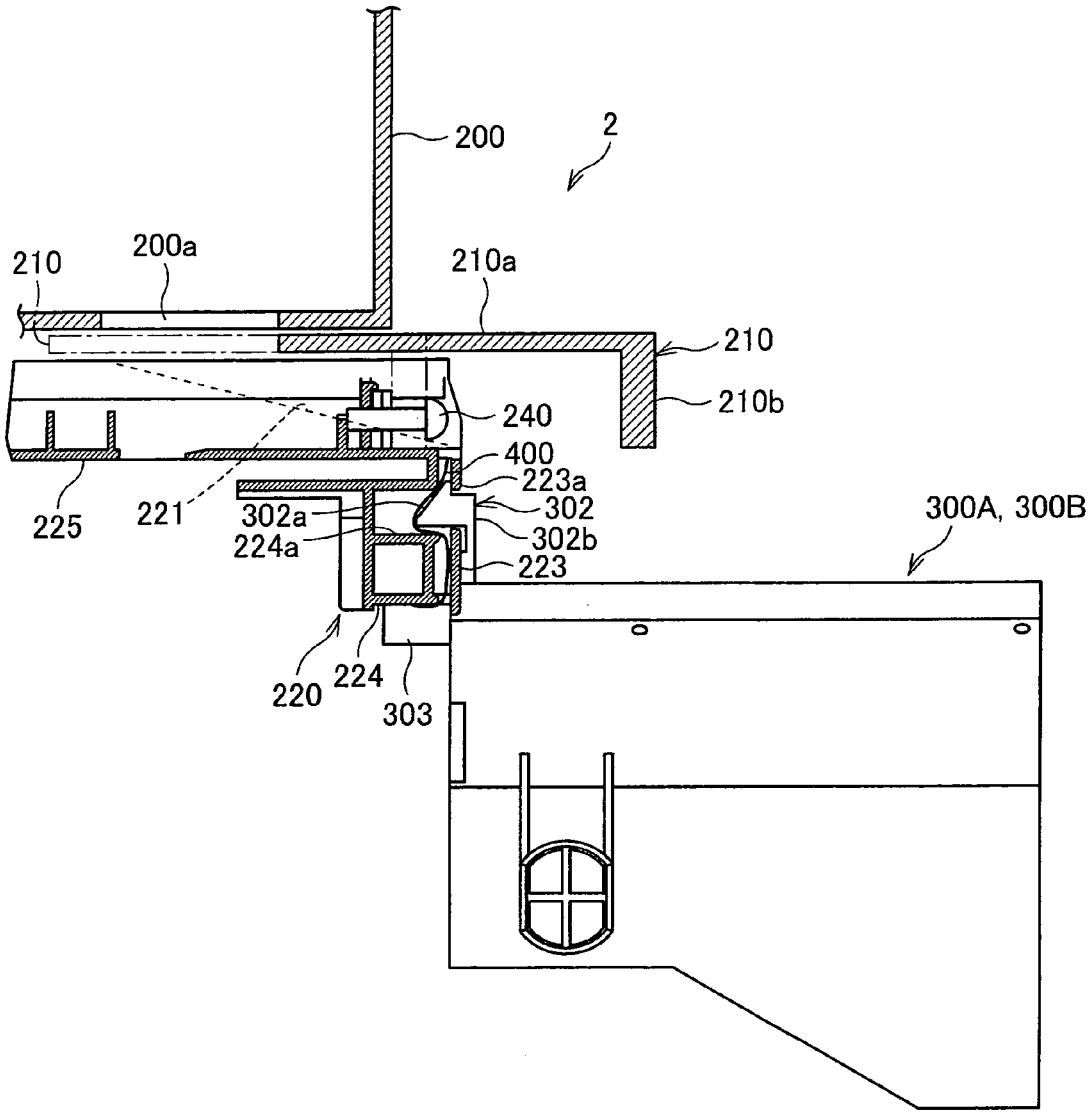
FIG. 10 is a partial cross-sectional view showing that the collecting container of FIG. 6

The contacting portion 303 is provided below the lower edge portion of the nail portion 302. The contacting portion 303 is in the form of a square and projects in the same direction as a top edge portion (a portion which is inserted into the opening portion 223*a*) of the nail portion 302. Moreover, as shown in FIG. 10, with the nail portion 302 inserted into the recess portion 224*a*, the contacting portion 303 is in contact with the lower edge surface of the collecting container holding portion 224. FIG. 10 is a partial cross-sectional view showing that the collecting container (300A, 300B) is attached to the developing device 2.

[Configuration of Developer Discharge Control Section 40]

Figure 11:
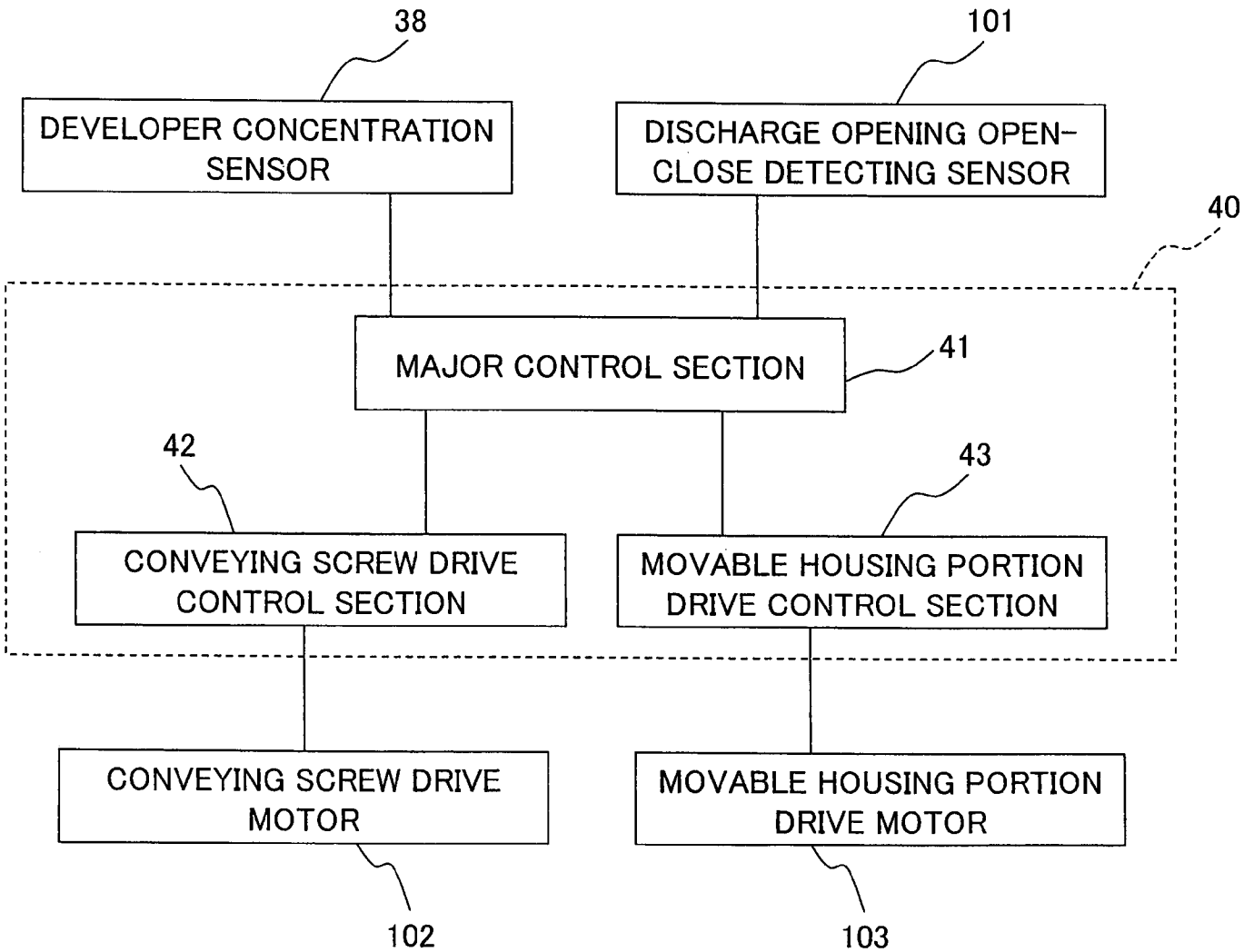
FIG. 11 is a block diagram showing a configuration of a developer discharge control section included in the waste developer collecting device of one embodiment.

The following will explain the developer discharge control section 40 which controls the operation of the developing device 2 when discharging the developer. FIG. 11 is a block diagram showing the configuration of the developer discharge control section 40. As shown in FIG. 11, the developer discharge control section 40 includes a major control section 41, a conveying screw drive control section 42, and a movable housing portion drive control section 43.

In the developer discharge control section 40, the major control section 41 is a brain which controls all the operations in the developer discharge control section 40. Moreover, the major control section 41 receives a detection signal from the developer concentration sensor 38 and a detection signal from a discharge opening open-close detecting sensor 101 which detects whether the developer discharge opening 200*a* is open or closed. The major control section 41 controls the conveying screw drive control section 42 and the movable housing portion drive control section 43 on the basis of the detection signals. Thus, the major control section 41 causes the conveying screws 33 and 34 and the movable housing portion 39*b* of the developer tank 35 to drive. Here, the developer discharge control section 40 or part of the developer discharge control section 40 may be included in a main control section of the image forming apparatus 100, or may be provided separately from the main control section of the image forming apparatus 100. Note that the main control section of the image forming apparatus 100 controls all the operations of the entire image forming apparatus 100.

The discharge opening open-close detecting sensor 101 outputs the detection signal when the discharge opening open-close detecting sensor 101 detects that the developer discharge opening 200*a* is completely open. The discharge opening open-close detecting sensor 101 is, for example, a light sensor having a light emitting portion and a light receiving portion. The light emitting portion is attached to either (i) any position, nearest to the front surface, on the developer discharge opening 200*a* or (ii) any position on the upper edge surface of the collecting container attachment portion 220, and the light receiving portion is attached to the opposite position so as to face the light emitting portion. As shown in FIG. 10, the light receiving portion of the light sensor receives the light emitted from the light emitting portion when the developer discharge opening 200*a* is completely open by the discharge opening shutter 210. Thus, by, for example, changing an output level from "L" to "H", the light sensor detects that the developer discharge opening 200*a* is completely open.

In accordance with an instruction from the major control section 41, the conveying screw drive control section 42 causes a conveying screw drive motor 102 to drive. Note that the conveying screw drive motor 102 causes the conveying screws 33 and 34 to rotate.

Figure 12:
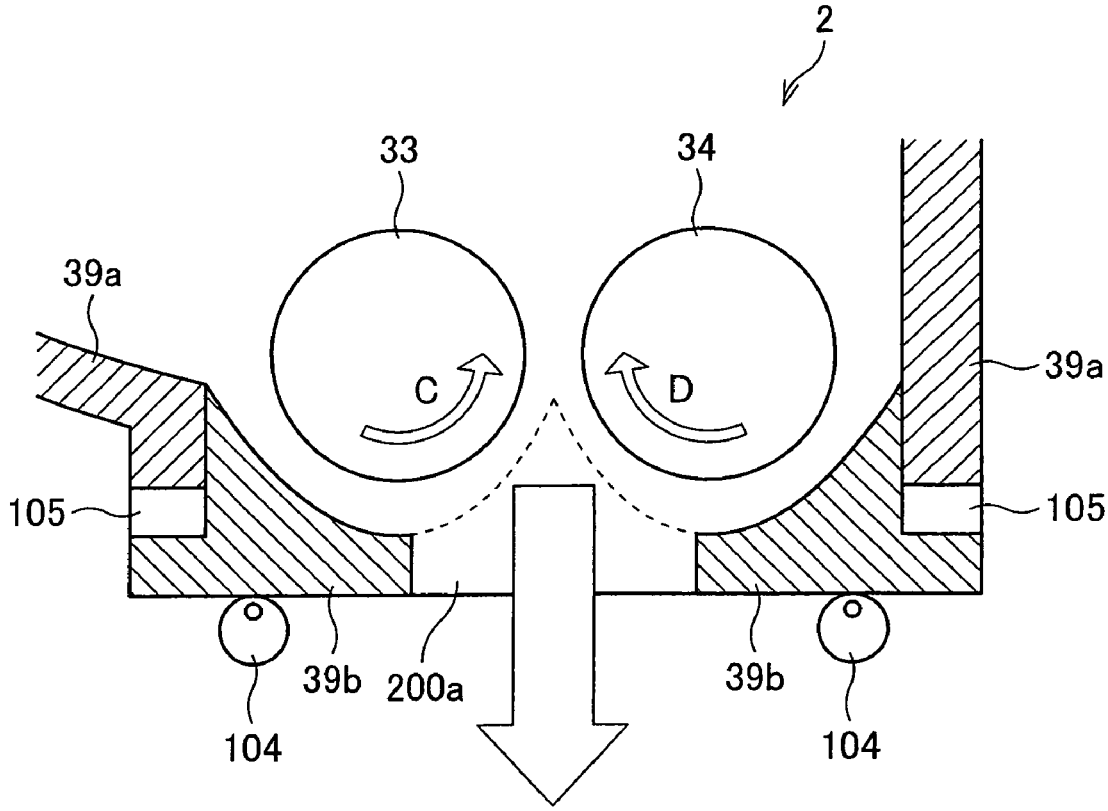
FIG. 12 is an explanatory diagram for explaining an operation of discharging the developer by the developing device of the waste developer collecting device of one embodiment.

Upon receiving the detection signal (a signal which informs that the developer discharge opening 200*a* is completely open) from the discharge opening open-close detecting sensor 101, the major control section 41 gives a control instruction to the conveying screw drive control section 42 so that the conveying screws 33 and 34 rotate. Then, the conveying screw drive control section 42 which has received this control signal causes the conveying screw drive motor 102 to rotate, and this causes the conveying screws 33 and 34 to rotate (idle). That is, with the developer not supplied to the photosensitive drums 3*a* to 3*d*, the conveying screws 33 and 34 are driven. In this state, the conveying screws 33 and 34 in the developer tank 35 of the developing device 2 rotate in an opposite direction, as shown in FIG. 12. Thus, the developer circulates in the developer tank 35 while the developer is being agitated. When the developer conveyed by the conveying screws 33 and 34 reaches the bottom portion of the developing device 2, the developer is discharged from the developer discharge opening 200*a*, slips on the discharging slope 221, and is collected by the collecting container 300A or 300B.

Moreover, upon receiving the detection signal which is from the developer concentration sensor (detecting section) 38 and indicates that the amount of the developer remaining in the developer tank 35 is a predetermined amount or smaller, the major control section 41 gives a control instruction to the movable housing portion drive control section 43 so that the movable housing portion 39*b* moves upwardly. Then, the movable housing portion drive control section 43 causes the movable housing portion drive motor 103 to drive, this causes the eccentric cam 104, connected to the movable housing portion drive motor 103, to rotate, and this further causes the movable housing portion 39*b* to move upwardly. Thus, as the operation of discharging the developer proceeds, the amount of the developer remaining in the developer tank 35 becomes a predetermined amount or smaller. When the amount of the developer in the developer tank 35 is a predetermined amount or smaller, the gap between the conveying screw (33, 34) and the movable housing portion 39*b* is made narrower than a normal gap (a gap when the amount of the developer stored in the developer tank 35 is larger than a predetermined amount).

In most of conventional image forming apparatuses, the gap between a conveying screw and a developer tank is set to 1 mm or wider. This is to prevent the occurrence of failures caused by the pinching of the developer in the gap. Similarly, in the image forming apparatus 100 of the present embodiment, when the amount of the developer in the developer tank 35 is larger than a predetermined amount, the gap between the conveying screw (33, 34) and the developer tank 35 (the movable housing portion 39*b*) is set to 1 mm or wider. Then, when the amount of the developer in the developer tank 35 is a predetermined amount or smaller, the movable housing portion 39*b* is caused to move upwardly, and this narrows the gap between the conveying screw (33, 34) and the movable housing portion 39*b* (for example, shorter than 1 mm). When the amount of the developer is small, the pinching of the developer rarely occurs even if the gap between the conveying screw (33, 34) and the movable housing portion 39*b* is narrowed (for example, shorter than 1 mm).

It is preferable that the minimum value of the gap between the movable housing portion 39*b* and the conveying screw (33, 34) when discharging the developer be set to a small value within such a range that the movable housing portion 39*b* and the conveying screw (33, 34) are not in contact with each other. In the present embodiment, three eccentric cams 104 support the movable housing portion 39*b*, that is, the movable housing portion 39*b* is supported by three points. With this, the moving-up and moving-down of the movable housing portion 39*b* can be stabilized, and the gap between the movable housing portion 39*b* and the conveying screw (33, 34) can be adjusted accurately. Therefore, it is possible to set the gap to a small value without causing the movable housing portion 39*b* and the conveying screws 33 and 34 to be in contact with each other.

[Process of Discharging Waste Developer]

Figure 13:
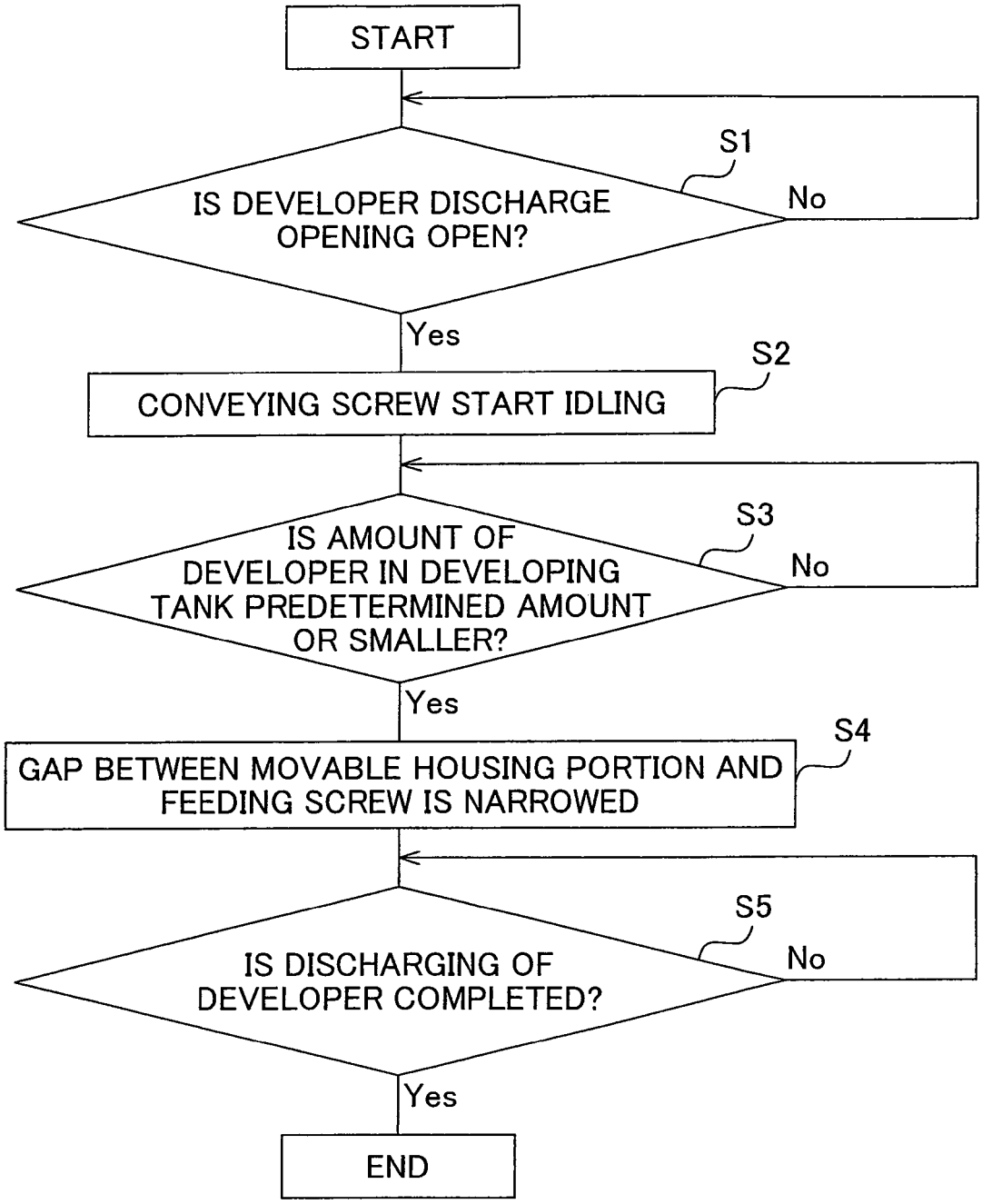
FIG. 13 is a flow chart showing a flow of steps carried out by the developer discharge control section shown in FIG. 11 when discharging the developer.

The following will explain a process of discharging and collecting the waste developer by the waste developer collecting device 50. FIG. 13 is a flow chart showing a flow of steps carried out by the major control section 41 when discharging the developer.

The following will explain the operations of discharging the C, M, Y, and K developers. Note that these operations are common to each other. Here, (i) the operations of discharging the C, M, Y, and K developers may be carried out simultaneously, (ii) the operations of discharging the C, M, Y, and K developers may be carried out one-by-one, or (iii) the operations of discharging the C, M, and Y developers may be carried out simultaneously, and the operation of discharging the K developer may be carried out separately.

First, to discharge the waste developer, a user attaches the collecting container 300A and/or 300B to the image forming apparatus 100 including the developing device 2 having the above-described configuration. Note that only the collecting container 300A may be attached for discharging the K developer, while only the collecting container 300B may be attached for discharging the other developer(s). Moreover, both the collecting containers 300A and 300B may be attached for discharging the K developer and the other developer(s).

As shown in FIG. 10, to attach the collecting container 300A and/or the collecting container 300B, the top edge portion 302*a* of the nail portion 302 is inserted through the opening portion 223*a* to the recess portion 224*a*. Thus, the upper edge portion of the top edge portion 302*a* is locked by the peripheral rim of the opening portion 223*a* formed on the inner edge surface of the front surface wall portion 223, and the lower edge surface of the horizontal portion of the supporting portion 302*b* is in contact with the upper edge rim of the opening portion 223*a*. In this way, the nail portion 302 is fixed to and held (connected) by the front surface wall portion 223. Meanwhile, when the nail portion 302 is fixed and held as above, the contacting portion 303 is in contact with the lower edge surface of the collecting container holding portion 224.

That is, the nail portion 302 and the contacting portion 303 sandwich the collecting container holding portion 224. Thus, the collecting container (300A, 300B) is fixed to and held by the collecting container holding portion 224. Moreover, in this state, the screw shielding member 400 is pushed toward the inside of the recess portion 224*a* by the top edge portion 302*a*. Thus, the upper edge portion of the screw shielding member 400 comes down, and therefore the head of the fixation screw 240 is exposed.

Next, the user opens the developer discharge opening 200*a* so as to secure a path for discharging the waste developer from the developing device 2 to the collecting container (300A, 300B). More specifically, (i) the fixation screw 240 is unscrewed so that the discharge opening shutter 210 can move, and then the discharge opening shutter 210 is pulled to open the developer discharge opening 200*a*.

The major control section 41 monitors the detection signal transmitted from the discharge opening open-close detecting sensor 101. On the basis of the detection signal, the major control section 41 judges whether the developer discharge opening 200*a* is open or not (S1).

When the major control section 41 judges that the developer discharge opening 200*a* is not open, the major control section 41 continuously monitors the transfer of the detection signal which is transmitted from the discharge opening open-close detecting sensor 101 and indicates that the developer discharge opening 200*a* is open.

Meanwhile, when the major control section 41 judges in S1 that the developer discharge opening 200*a* is open, the major control section 41 causes the conveying screws 33 and 34 to idle (S2). That is, to the conveying screw drive control section 42, the major control section 41 sends the control instruction for causing the conveying screw drive motor 102 to drive. Note that the conveying screw drive motor 102 causes the conveying screws 33 and 34 to rotate.

Next, the major control section 41 judges whether or not the amount of the developer remaining in the developer tank 35 is a predetermined amount or smaller (S3). Specifically, the major control section 41 judges whether or not the output (detection signal) of the developer concentration sensor 38 is a predetermined value or less. Note that this predetermined value is set to a value corresponding to the above-described predetermined amount or smaller of the developer in the developer tank 35. Moreover, the predetermined amount is such an amount that the pinching of the developer does not occur even if the gap between the conveying screw (33, 34) and the movable housing portion 39*b* is narrowed.

Then, when the major control section 41 judges in S3 that the amount of the developer remaining in the developer tank 35 is not a predetermined amount or smaller, the major control section 41 continuously monitors whether or not the amount of the developer in the developer tank 35 is a predetermined amount or smaller.

Then, when the major control section 41 judges in S3 that the amount of the developer remaining in the developer tank 35 is a predetermined amount or smaller, the major control section 41 narrows the gap between the movable housing portion 39*b* and the conveying screw (33, 34) (S4). That is, to the movable housing portion drive control section 43, the major control section 41 sends the control instruction for causing the movable housing portion drive motor 103 to drive. Note that the movable housing portion drive motor 103 is connected to the eccentric cam(s) 104 for causing the movable housing portion 39*b* to move upwardly and downwardly, and the movable housing portion drive motor 103 causes the eccentric cam(s) 104 to rotate. Moreover, the gap between the movable housing portion 39*b* and the conveying screw (33, 34) after S4 may be set to a predetermined value within such a range that the movable housing portion 39*b* and the conveying screw (33, 34) are not in contact with each other.

Then, the major control section 41 judges whether or not the discharging of the developer is completed (S5). That is, on the basis of the detection signal transmitted from the developer concentration sensor 38, the major control section 41 judges whether or not the discharging of the developer in the developer tank 35 is completed.

Then, when the major control section 41 judges in S5 that the discharging of the developer is not completed, the major control section 41 continuously monitors the completion of the discharging of the developer. Meanwhile, when the major control section 41 judges in S5 that the discharging of the developer is completed, the major control section 41 terminates the control regarding the discharging of the developer.

As above, the waste developer collecting device 50 of the present embodiment is provided with the collecting container 300B so that the collecting container 300B for collecting the C, M, and Y developers collects at a specific fixed position (which is such a fixed position that the collecting container 300B can collect the C, M, and Y developers without relocating the collecting container 300B) the developers discharged from the respective color developing devices.

On this account, for collecting the C, M, and Y developers, it is not necessary to repeatedly attach collecting containers for respective colors. Thus, it is possible to improve the work efficiency. Moreover, since it is not necessary to carry the collecting containers for respective colors of C, M, and Y, it is easy to move and it is possible to improve the work efficiency.

The collecting container 300B is used to collect the C, M and Y developers in the present embodiment, however the present embodiment is not limited to this. For example, (i) a single collecting container may be used for collecting the K, C, M, and Y developers, or (ii) one collecting container may be used for collecting the K and C developers, and another collecting container may be used for collecting the M and Y developers. That is, any collecting container(s) can be used as long as the developers discharged from a plurality of developing devices are collected by using the collecting container(s) which is so provided as to be able to collect the developers at a specific fixed position (which is such a fixed position that the collecting container 300B can collect the developers discharged from a plurality of developing devices, without relocating the collecting container 300B).

Generally, the frequency of use of the K developer is higher than the frequency of use of each of the C, M, and Y developers, and respective frequencies of use of the C, M, and Y developers are substantially equal to each other. Therefore, in many cases, the cycle of exchanging the K developer is different from the cycle of exchanging each of the C, M, and Y developers. In this case, it is preferable that the collecting container 300A that is a collecting container for one color be used for the K developer, and the collecting container 300B be used for the C, M, and Y developers.

Moreover, as shown in FIG. 8, in the present embodiment, the developers collected by the collecting container 300B are stored in a single collecting tank 306, so that the developers are mixed in the collecting tank 306. Normally, the collected developers are disposed of in the same manner irrespective of the color of the developer. Therefore, the mixing of the collected developers is not especially problematic.

Figure 14:
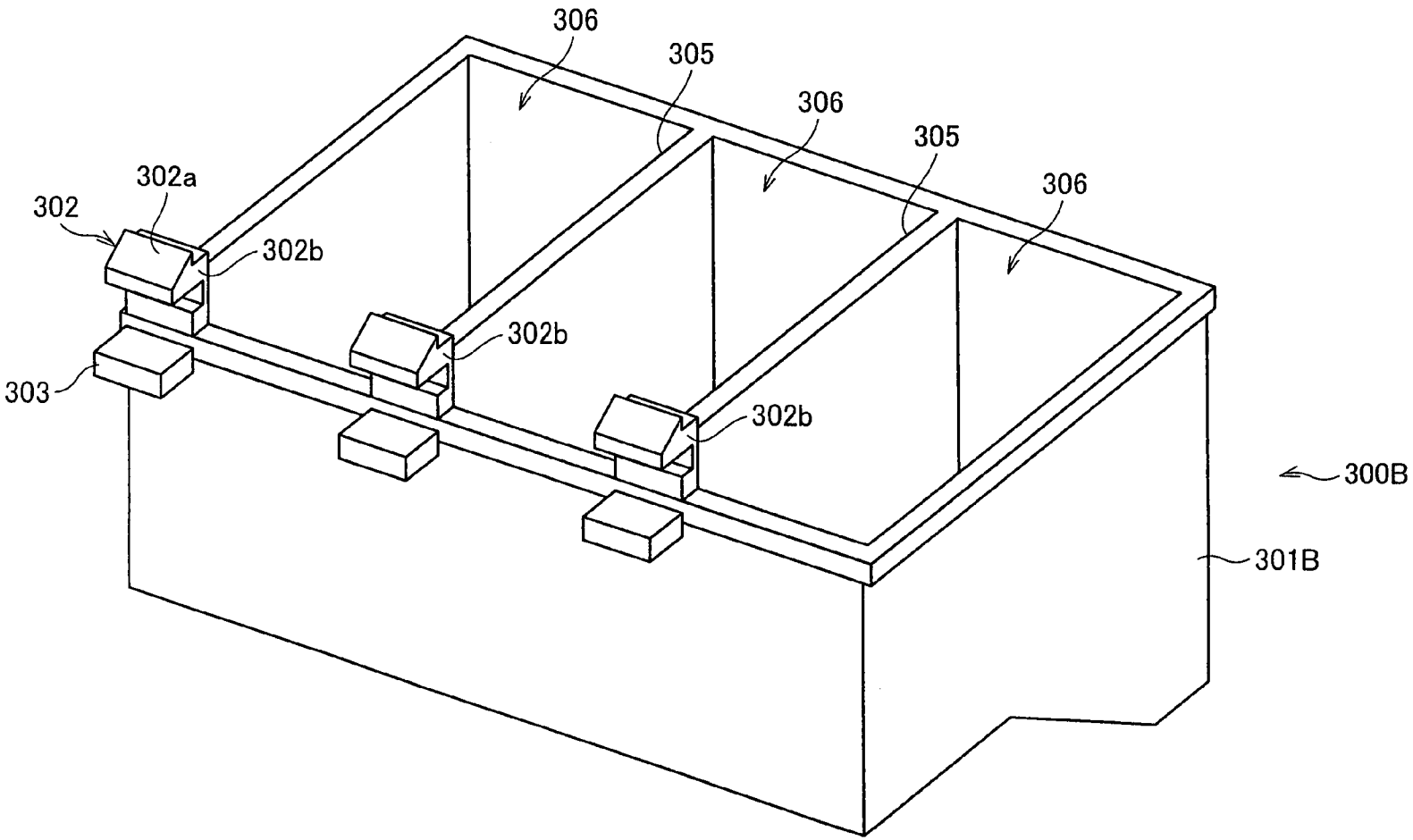
FIG. 14 is a perspective view showing a modified example of the collecting container included in the waste developer collecting device of one embodiment.

However, if it is necessary to separately collect the developers for each color or for each developer tank, the collecting container 300B may include such a collecting tank 306 that the developers can be separately collected. For example, as shown in FIG. 14, dividers 305 may be provided in the collecting container 300B so that the collecting tanks 306 for respective colors are formed.

Moreover, for example, the collecting container 300A that is a collecting container for one color can have connection means for realizing the connection with another collecting container 300A. In this case, the collecting containers 300A are connected with each other, so that one integrally-formed collecting container can be used for two or more developer tanks. For example, a plurality of collecting containers 300A may be connected with each other by forming a depressed portion (not shown) on one side surface of each collecting container 300A and a projected portion (not shown) on another side surface of each collecting container 300A so that the depressed portion and the projected portion are connected with each other.

Moreover, the collecting container 300B includes three sets of the nail portion 302 and the contacting portion 303, however the present embodiment is not limited to this. That is, any member can be used as long as the member can stably fix the collecting container 300B when collecting the developers, and it is not necessary that the number of sets of the nail portion 302 and the contacting portion 303 correspond to the number of the developing devices which collect the developer. For example, in the collecting container 300B, it may be possible to omit the nail portion 302 and the contacting portion 303 which are provided at a position corresponding to the developing device 2*c*.

Moreover, the present embodiment uses the collecting containers 300A and 300B each having the collecting tank 306 which is in the form of an upwardly opening box, however the present embodiment is not limited to this. For example, as shown in FIGS. 15(*a*) and 15(*b*), it is possible to use a collecting container 300C including (i) a frame portion (arm) 307 including the nail portion 302 and the contacting portion 303 and (ii) a fit frame portion 308 which can fit the frame portion 307.

Figure 15:
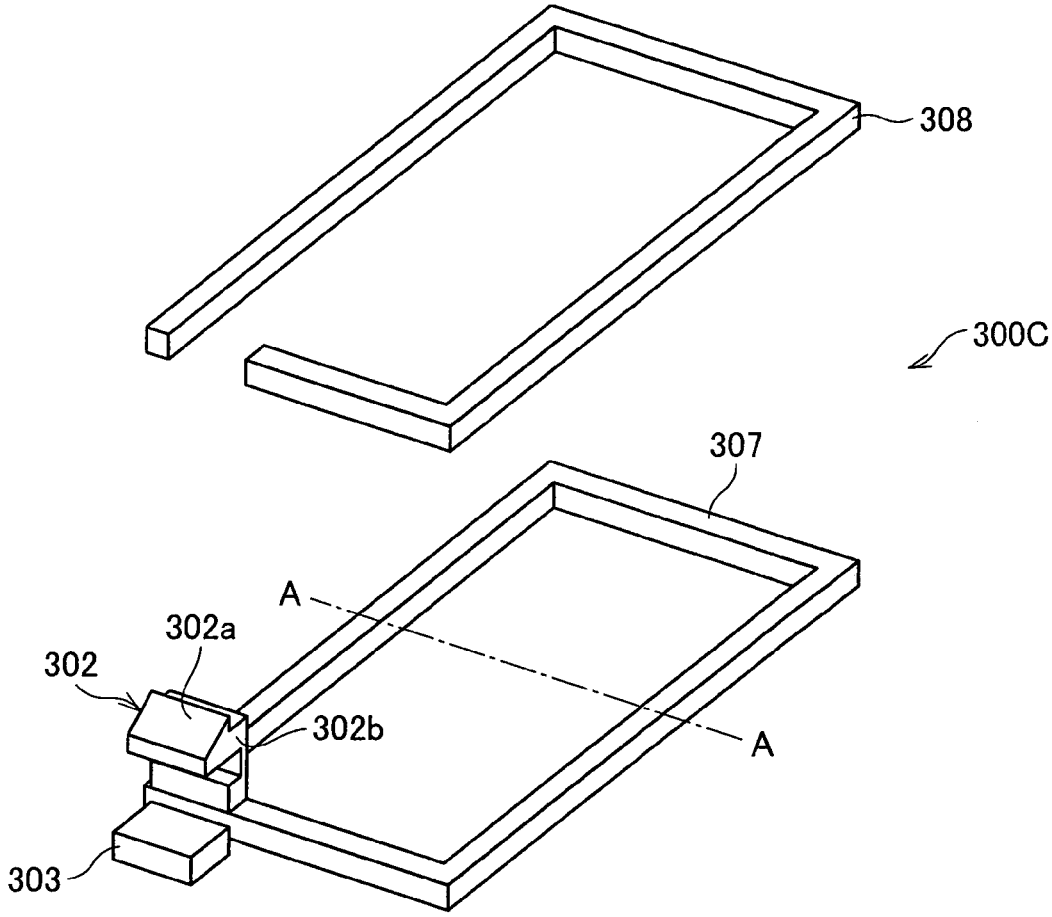
FIG. 15(*a*) is a perspective view showing a modified example of the collecting container included in the waste developer collecting device of one embodiment, and FIG. 15(*b*) is a cross-sectional view taken along the line A-A of FIG. 15(*a*).
Figure 15:
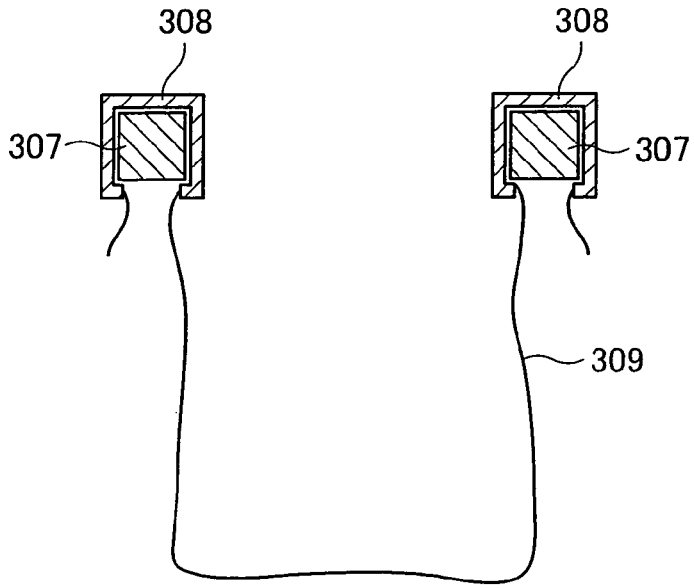

As shown in FIG. 15(*b*), in the collecting container 300C, the fit frame portion 308 fits the frame portion 307 so that a bag 309 is sandwiched between the frame portion 307 and the fit frame portion 308. Specifically, the vicinity of the opening (edge portion) of the bag 309 is placed on the frame portion 307, and the fit frame portion 308 fits the frame portion 307 so that the bag 309 is sandwiched between the frame portion 307 and the fit frame portion 308. Thus, the bag 309 is set along the shape of the frame portion 307 and opens upwardly. In this way, the bag 309 can function as a collecting tank for storing the discharged developer.

Moreover, FIGS. 15(*a*) and 15(*b*) show the collecting container 300C including the frame portion 307 having only one set of the nail portion 302 and the contacting portion 303. However, the present embodiment is not limited to this. The collecting container 300C may include a plurality of sets of the nail portion 302 and the contacting portion 303, and this plurality of sets of the nail portion 302 and the contacting portion 303 may be attached to a plurality of developer tanks simultaneously.

Figure 16:
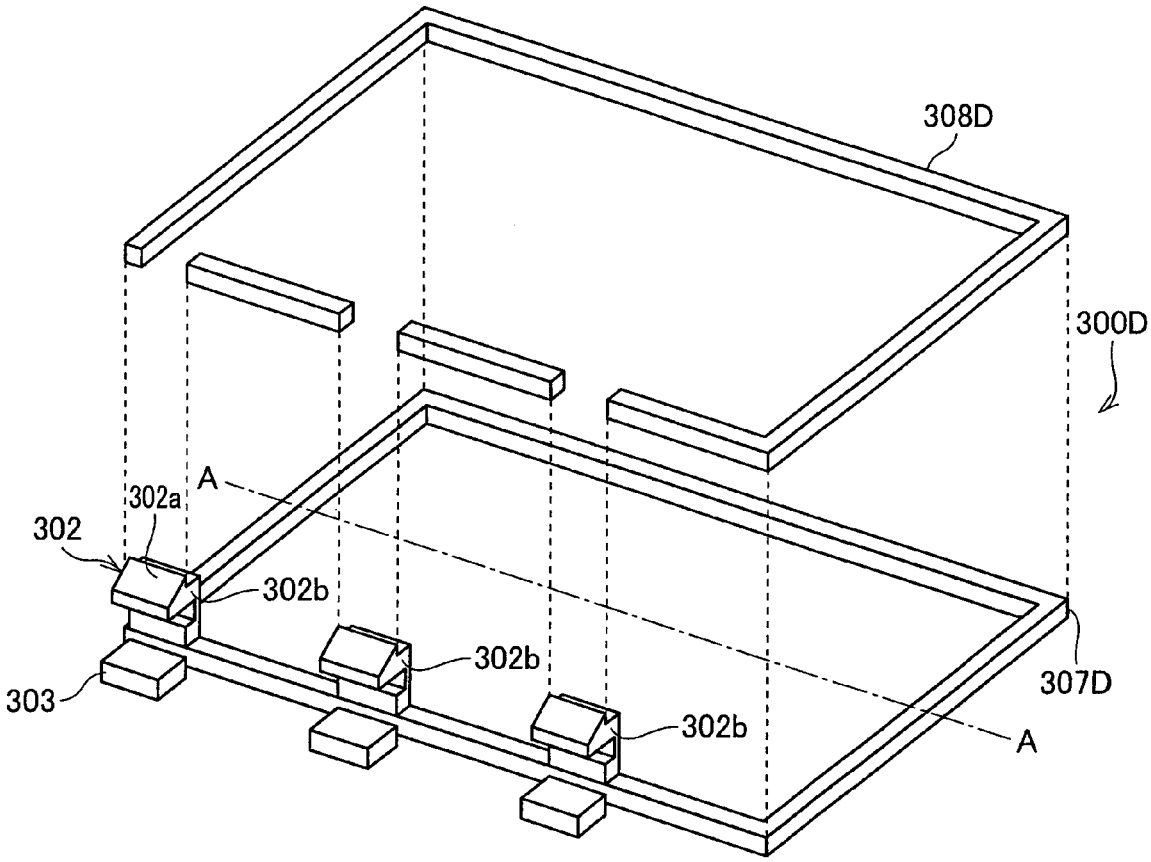
FIG. 16(*a*) is a perspective view showing a modified example of the collecting container included in the waste developer collecting device of one embodiment, and FIG. 16(*b*) is a cross-sectional view taken along the line A-A of FIG. 15(*a*).
Figure 16:
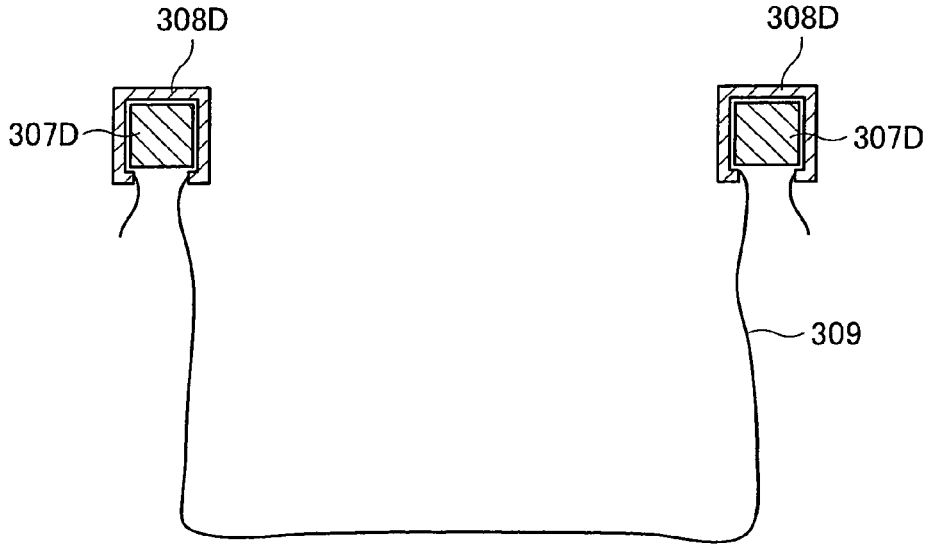

For example, as shown in FIGS. 16(*a*) and 16(*b*), it is possible to use a collecting container 300D including (i) a frame portion 307D including three sets of the nail portion 302 and the contacting portion 303 and (ii) a fit frame portion 308D which can fit the frame portion 307D. Note that in an example shown in FIGS. 16(*a*) and 16(*b*), three sets of the nail portion 302 and the contacting portion 303 are provided at positions which correspond to the collecting container attachment portion 220 of the developing device 2*b* (M), the collecting container attachment portion 220 of the developing device 2*c* (C), and the collecting container attachment portion 220 of the developing device 2*d* (Y), respectively.

In the collecting container 300D configured as above, the vicinity of the opening (edge portion) of the bag 309 is placed on the frame portion 307D, and the fit frame portion 308D fits the frame portion 307D so that the bag 309 is sandwiched between the frame portion 307D and the fit frame portion 308D. Thus, the bag 309 is set along the shape of the frame portion 307D and opens upwardly. In this way, the bag 309 can function as a collecting tank for storing the developers discharged from the developing devices 2*b*, 2*c*, and 2*d*.

As the bag 309, it is preferable to use a bag made of a soft elastic body which can change its shape easily. For example, as the bag 309, it is possible to use a bag made of synthetic resin, such as a plastic bag and a polyethylene bag. Moreover, any bag can be used as the bag 309 as long as the bag can store the developer without leakage. The bag 309 may be a bag made of paper, cloth, rubber, a metal film, etc. Moreover, the bag 309 may be a dedicated bag made for placing on the collecting container, or may be a general bag distributed in a supermarket or a convenience store for putting merchandise therein.

By using as the collecting tank of the collecting container the bag 309 made of the soft elastic body which can change its shape easily, it is easy to carry the collecting container since the bag 309 can change its shape, and thus it is possible to improve the work efficiency. In addition, it is possible to save a space for keeping the collecting container.

Moreover, in the above-described configuration, the bag 309 can be exchangeably placed on the collecting container. On this account, for example, the developer collected in the bag 309 can be disposed of only by closing the opening of the bag 309. Therefore, it is not necessary to transfer the collected developer into, for example, a bag or container for disposal. Thus, it is possible to improve the work efficiency.

Moreover, in the present embodiment, when the amount of the developer in the developer tank 35 becomes a predetermined amount or smaller, the gap between the conveying screw (33, 34) and the movable housing portion 39*b* is narrowed. Therefore, although it is difficult for the conventional techniques to discharge the developer remaining between a conveying screw and a housing of a developer tank, the present embodiment can efficiently discharge and collect this remaining developer. That is, it is possible to reduce the amount of the developer remaining in the developer tank 35, and the developer can be discharged and collected efficiently.

In the present embodiment, to narrow the gap between the conveying screw (33, 34) and the housing of the developer tank 35, the bottom portion (movable housing portion 39*b*) of the developer tank 35 can move upwardly and downwardly. However, the present embodiment is not limited to this. For example, the gap between the conveying screw (33, 34) and the housing of the developer tank 35 may be narrowed by causing the positions of the conveying screws 33 and 34 to move by using means for causing the rotating shafts of the conveying screws 33 and 34 to move upwardly and downwardly.

Moreover, a mechanism of causing the movable housing portion 39*b* to move upwardly and downwardly is not limited to the above examples. For example, four or more eccentric cams 104 may be used. Moreover, it may be possible to use two thin and long eccentric cams 104 extending in a direction substantially parallel to or perpendicular to a direction in which the conveying screws 33 and 34 extend.

Moreover, the present embodiment is not limited to the configuration using the eccentric cam 104, and the other mechanism may be used to cause the movable housing portion 39*b* to move upwardly and downwardly. For example, the present embodiment may include (i) a lead screw (not shown) provided in a direction parallel to a direction in which the movable housing portion 39*b* moves upwardly and downwardly, (ii) an arm (not shown) which engages the lead screw, converts the rotational movement of the lead screw into the linear movement in a direction in which the movable housing portion 39*b* moves upwardly and downwardly, and transmits the force of this linear movement to the movable housing portion 39*b*, and (iii) a motor for causing the lead screw to rotate. By controlling the rotation of this motor, the movable housing portion 39*b* may be caused to move upwardly and downwardly.

Moreover, in the present embodiment, when the amount of the developer in the developer tank 35 becomes a predetermined amount or smaller, the gap between the conveying screw (33, 34) and the movable housing portion 39*b* is narrowed. That is, the gap between the conveying screw (33, 34) and the movable housing portion 39*b* is different between when the amount of the developer is larger than a predetermined amount and when the amount of the developer is a predetermined amount or smaller, in other words, there are two sizes of the gap. However, the present embodiment is not limited to two sizes of the gap between the conveying screw (33, 34) and the movable housing portion 39*b*. For example, in accordance with the amount of the developer in the developer tank 35, many sizes of the gap may be used, or the gap may be changed continuously.

Moreover, in the present embodiment, the gap between the conveying screw (33, 34) and the housing of the developer tank 35 is controlled in accordance with the detection signal of the developer concentration sensor 38. However, the present embodiment is not limited to this. For example, (i) the gap may be controlled in accordance with an elapsed time since the start of the discharge of the developer, (ii) the gap may be controlled in accordance with the result of the detection by a liquid level sensor for detecting the liquid level of the developer, (iii) the gap may be controlled in accordance with the result of the detection by means for detecting the amount of the developer discharged from the developer discharge opening 200*a*, (iv) the gap may be controlled in accordance with an instruction given by the user using input means (not shown), and (v) the gap may be controlled by a combination of some of the above-described methods.

Moreover, the present embodiment includes the discharge opening open-close detecting sensor 101 which detects that the developer discharge opening 200*a* is completely open. When the discharge opening open-close detecting sensor 101 detects that the developer discharge opening 200*a* is completely open, the major control section 41 starts the idling of the conveying screws 33 and 34. With this, when the user pulls out the discharge opening shutter 210 so as to completely open the developer discharge opening 200*a*, the developing device 2 automatically idles, and the waste developer is automatically discharged and collected. Therefore, it is not necessary for the user to carry out another operation for causing the developing device 2 to idle. However, the present embodiment is not limited to this. For example, the idling of the conveying screws 33 and 34 may be started in accordance with an instruction supplied by the user using input means (not shown).

To solve the above-described problems, (i) a waste developer collecting device is included in an image forming apparatus including a plurality of developing devices which respectively carry out development processes with developers containing toner and carrier, (ii) the waste developer collecting device collects waste developers used in and discharged from the developing devices, (iii) the waste developer collecting device includes: a collecting container for collecting the developers discharged from the developing devices; and a collecting container fixing section for fixing the collecting container by causing the collecting container to be positioned so that the collecting container is able to collect the developers discharged from the developing devices, and (iv) the collecting container is provided at a specific fixed position by the collecting container fixing section so that the collecting container is able to collect the developers discharged from at least two or more of the above-described plurality of the developing devices.

According to the above-described configuration, the collecting container is fixed at the specific fixed position, so that the collecting container can collect at this fixed position the developers discharged from a plurality of the developing devices. Therefore, when collecting the developers discharged from at least two or more developing devices, it is not necessary to attach one collecting containers for each developing device. On this account, the developer can be discharged and collected efficiently. Moreover, to collect the developers discharged from at least two or more developing devices, it is not necessary to prepare and carry a plurality of the collecting containers. Therefore, it is possible to improve the work efficiency.

Moreover, the image forming apparatus includes the developing device which carries out the development process with a black developer and a plurality of the developing devices which respectively carry out the development processes with the developers other than the black developer, and the collecting container is provided at the specific fixed position by the collecting container fixing section so that the collecting container is able to collect the developers discharged from at least two or more of the above-described plurality of the developing devices which respectively carry out the development processes with the developers other than the black developer.

Generally, the frequency of use of the black developer is higher than the frequency of use of each of the other (chromatic color) developers, and respective frequencies of use of the other (chromatic color) developers are substantially equal to each other. Therefore, in many cases, the other (chromatic color) developers are exchanged for the new ones at the same time.

According to the above-described configuration, the collecting container is provided at the specific fixed position by the collecting container fixing section so that the collecting container is able to collect the developers discharged from at least two or more of the above-described plurality of the developing devices which respectively carry out the development processes with the developers other than the black developer. Therefore, when collecting the chromatic color developers, it is not necessary to attach one collecting container for each developing device using the chromatic color developer. On this account, the developer can be discharged and collected effectively. Moreover, it is not necessary to prepare a plurality of collecting containers each of which collects the developers discharged from at least two or more developing devices using the chromatic color developers, and it is not necessary to carry a plurality of collecting containers. Therefore, it is possible to improve the work efficiency.

Moreover, the collecting container collects the developers, discharged from at least two or more developing devices, separately for each developing device.

According to the above-described configuration, it is possible to collect the developers separately for each developing device. Therefore, when it is necessary to separate the developers for disposal, or when it is necessary to separate the developers for recycling, it is possible to appropriately collect the developers separately.

The collecting container may include a collecting tank, which is a bag made of a soft elastic body, for storing the developers collected.

Moreover, to solve the above-described problems, (i) another waste developer collecting device collects a waste developer used in and discharged from a developing device which carries out a development process with a developer containing toner and carrier, (ii) the waste developer collecting device includes: a collecting container for collecting the developer discharged from the developing device; and a collecting container fixing section for fixing the collecting container by causing the collecting container to be positioned so that the collecting container is able to collect the developer discharged from the developing device, and (iii) the collecting container includes a collecting tank, which is a bag made of a soft elastic body, for storing the developer collected.

In the waste developer collecting device having any one of the above-described configurations, the collecting tank included in the collecting container is the bag made of the soft elastic body. Note that the bag made of the elastic body is a bag which can easily change its shape. Examples of the bag made of the soft elastic body are a bag made of synthetic resin, such as a plastic bag and a polyethylene bag, and a bag made of paper, cloth, rubber a metal film, etc. Thus, by using as the collecting tank of the collecting container the bag made of the soft elastic body which can easily change its shape, for example, the carrier can carry the collecting container easily by changing the shape of the bag. Thus, the work efficiency can be improved, and a space for keeping the collecting container can be saved.

Moreover, in the waste developer collecting device having any one of the above-described configurations, the collecting tank may be exchangeably placed with respect to the collecting container.

According to the above-described configuration, when carrying the collecting container, the bag that is the collecting container can be carried separately. Therefore, it is possible to further improve the mobility of the carrier, and also possible to improve the work efficiency. Moreover, for example, the developer collected in the bag can be disposed of only by closing the opening of the bag. Therefore, it is not necessary to transfer the collected developer into, for example, a bag or container for disposal. Thus, it is possible to improve the work efficiency.

Moreover, in any one of the above-described waste developer collecting devices, the developing device may include: a developer tank for storing the developer; a developer discharge opening which is formed at a bottom of the developer tank and is openable and closable; a conveying section for conveying to the developer discharge opening the developer stored in the developer tank; and an interval change section which changes an interval between the bottom of the developer tank and the conveying section.

Moreover, to solve the above-described problems, (i) still another waste developer collecting device collects a waste developer used in and discharged from a developing device which carries out a development process with a developer containing toner and carrier, and (ii) the developing device includes: a developer tank for storing the developer; a developer discharge opening which is formed at a bottom of the developer tank and is openable and closable; a conveying section for conveying to the developer discharge opening the developer stored in the developer tank; and an interval change section which changes an interval between the bottom of the developer tank and the conveying section.

According to any one of the above-described configurations, it is possible to change the interval between the bottom of the developer tank and the conveying section. Therefore, for example, by narrowing the interval between the conveying section and the bottom of the developer tank when the amount of the developer in the developer tank is a predetermined amount or smaller, it is possible to efficiently discharge the developer remaining between the conveying section and the bottom of the developer tank, although it is difficult for the conventional techniques to discharge this remaining developer. That is, it is possible to reduce the amount of the developer remaining in the developer tank, and it is possible to efficiently discharge the developer.

Moreover, any one of the above-described waste developer collecting devices may further include: a detecting section for detecting an amount of the developer in the developer tank; and a control section for controlling an operation of the interval change section in accordance with a result of a detection carried out by the detecting section.

According to the above-described configuration, the interval between the bottom of the developing device and the conveying section can be changed in accordance with the result of the detection of the amount of the developer in the developer tank. Therefore, for example, by narrowing the interval between the conveying section and the bottom of the developer tank when the result of the detection indicates that the amount of the developer in the developer tank is a predetermined amount or smaller, it is possible to reduce the amount of the developer remaining in the developer tank, and it is possible to efficiently discharge the developer.

To solve the above-described problems, an image forming apparatus includes the waste developer collecting device having any one of the above-described configurations. On this account, it is possible to discharge and collect the developer efficiently.

To solve the above-described problems, (i) a waste developer collecting method is a method for collecting a waste developer used in and discharged from a developing device including: a developer tank for storing a developer containing toner and carrier; a developer discharge opening which is formed at a bottom of the developer tank and is openable and closable; and a conveying section for conveying to the developer discharge opening the developer stored in the developer tank, (ii) the waste developer collecting method includes the steps of: detecting an amount of the developer in the developer tank; and changing an interval between a bottom of the developer tank and the conveying section in according with a result of a detection in the above-described detecting step.

According to the above-described method, the interval between the bottom of the developer tank and the conveying section is changed in accordance with the result of the detection of the amount of the developer in the developer tank. Therefore, for example, by narrowing the interval between the conveying section and the bottom of the developer tank when the result of the detection indicates that the amount of the developer in the developer tank is a predetermined amount or smaller, it is possible to reduce the amount of the developer remaining in the developer tank, and it is possible to efficiently discharge the developer.

The present technology is applicable to (i) an image forming apparatus which carries out an image formation with a powder developer, and (ii) a waste developer collecting device included in this image forming apparatus.

The embodiments and concrete examples of implementation discussed in the foregoing detailed explanation serve solely to illustrate the technical details, which should not be narrowly interpreted within the limits of such embodiments and concrete examples, but rather may be applied in many variations, provided such variations do not exceed the scope of the patent claims set forth below.

What is claimed is:

1. A waste developer collecting device (i) which is included in an image forming apparatus including a plurality of developing devices which respectively carry out development processes with a black developer and a plurality of developers other than the black developer, the developers containing toner and carrier and (ii) which collects waste developers used in and discharged from the developing devices, comprising:

a first collecting container for collecting the developer discharged from the developing device that carries out development with a black developer;

a second collecting container for collecting the developer discharged from at least two of the developing devices that carry out development with developers other than the black developer; and a collecting container fixing section for fixing the first and second collecting containers to cause the collecting containers to be positioned so that the collecting containers are able to collect the developers discharged from the developing devices, the second collecting container being provided at a specific fixed position by the collecting container fixing section so that the second collecting container is able to collect the developers discharged from at least two or more of said plurality of the developing devices which respectively carry out the development processes with the developers other than the black developer.

2. The waste developer collecting device as set forth in claim 1, wherein the second collecting container collects the developers, discharged from at least two or more developing devices, separately for each developing device.

3. The waste developer collecting device as set forth in claim 1, wherein the first and second collecting containers include a collecting tank, which is a bag made of a soft elastic body, for storing the developers collected.

4. The waste developer collecting device as set forth in claim 3, wherein the collecting tank is exchangeably placed with respect to the collecting container.

5. A waste developer collecting device which collects a waste developer used in and discharged from a developing device which carries out a development process with a developer containing toner and carrier, comprising:

a collecting container for collecting the developer discharged from the developing device; and a collecting container fixing section for fixing the collecting container by causing the collecting container to be positioned so that the collecting container is able to collect the developer discharged from the developing device and wherein the developing device includes:

a developer tank for storing the developer;

a developer discharge opening which is formed at a bottom of the developer tank and is openable and closable;

a conveying section for conveying to the developer discharge opening the developer stored in the developer tank; and an interval change section which changes an interval between the bottom of the developer tank and the conveying section.

6. The waste developer collecting device as set forth in claim 5, wherein the collecting container includes a collecting tank which is a bag made of a soft elastic body, and wherein the collecting tank is exchangeably placed with respect to the collecting container.

7. The waste developer collecting device as set forth in claim 5, further comprising:

a detecting section for detecting an amount of the developer in the developer tank; and a control section for controlling an operation of the interval change section in accordance with a result of a detection carried out by the detecting section.

8. A apparatus including a plurality of developing devices which respectively carry out development processes with developers containing toner and carrier and (ii) which collects waste developers used in and discharged from the developing devices, comprising:

a collecting container for collecting the developers discharged from the developing devices; and a collecting container fixing section for fixing the collecting container by causing the collecting container to be positioned so that the collecting container is able to collect the developers discharged from the developing devices, the collecting container being provided at a specific fixed position by the collecting container fixing section so that the collecting container is able to collect the developers discharged from at least two or more of said plurality of the developing devices wherein each of the developing devices includes:

a developer tank for storing the developer;

a developer discharge opening which is formed at a bottom of the developer tank and is openable and closable;

a conveying section for conveying to the developer discharge opening the developer stored in the developer tank; and an interval change section which changes an interval between the bottom of the developer tank and the conveying section.

9. The waste developer collecting device as set forth in claim 8, further comprising:

a detecting section for detecting an amount of the developer in the developer tank; and a control section for controlling an operation of the interval change section in accordance with a result of a detection carried out by the detecting section.

10. A waste developer collecting device which collects a waste developer used in and discharged from a developing device which carries out a development process with a developer containing toner and carrier, the developing device comprising:

a developer tank for storing the developer;

a developer discharge opening which is formed at a bottom of the developer tank and is openable and closable;

a conveying section for conveying to the developer discharge opening the developer stored in the developer tank; and an interval change section which changes an interval between the bottom of the developer tank and the conveying section.

11. The waste developer collecting device as set forth in claim 10, further comprising:

a detecting section for detecting an amount of the developer in the developer tank; and a control section for controlling an operation of the interval change section in accordance with a result of a detection carried out by the detecting section.

12. An image forming apparatus, comprising:

a plurality of developing devices which respectively carry out development processes with developers containing toner and carrier, wherein the developing devices include a developing device that carries out a development process with a black developer and a plurality of developing devices which respectively carry out development processes with developers other that the black developer; and a waste developer collecting device which collects waste developers used in and discharged from the developing devices, the waste developer collecting device including:

a first collecting container for collecting the developer discharged from the developer that uses a black developer;

a second collecting container for collecting developers discharged from at least two of the developing devices that use a developer other than the black developer; and a collecting container fixing section for fixing the first and second collecting containers by causing the collecting containers to be positioned so that the collecting containers are able to collect the developers discharged from the developing devices, the second collecting container being provided at a specific fixed position by the collecting container fixing section so that the second collecting container is able to collect the developers discharged from at least two or more of said plurality of the developing devices, which respectively carry out the development process with the developers other than the black developer.

13. An image forming apparatus, comprising:

a plurality of developing devices which respectively carry out development processes with developers containing toner and carrier; and a waste developer collecting device which collects waste developers used in and discharged from the developing devices, the waste developer collecting device including:

a collecting container for collecting the developers discharged from the developing devices; and a collecting container fixing section for fixing the collecting container by causing the collecting container to be positioned so that the collecting container is able to collect the developers discharged from developing devices, the collecting container including a collecting tank which is a bag made of a soft elastic body, for storing the developer collected;

and wherein at least one of the developing devices includes:

a developer tank for storing the developer;

a developer discharge opening which is formed at a bottom of the developer tank and is openable and closable;

a conveying section for conveying to the developer discharge opening the developer stored in the developer tank; and an interval change section which changes an interval between the bottom of the developer tank and the conveying section.

14. An image forming apparatus comprising a waste developer collecting device which collects a waste developer used in and discharged from a developing device which carries out a development process with a developer containing toner and carrier, the developing device including:

a developer tank for storing the developer;

a developer discharge opening which is formed at a bottom of the developer tank and is openable and closable;

a conveying section for conveying to the developer discharge opening the developer stored in the developer tank; and an interval change section which changes an interval between the bottom of the developer tank and the conveying section.

15. The image forming apparatus of claim 14, wherein the interval change section causes the bottom of the developer tank to move closer to the conveying section.

16. The image forming apparatus of claim 14, wherein the interval change section causes the conveying section to move closer to the bottom of the developer tank.

17. The image forming apparatus of claim 14, wherein the interval change section comprises at least one cam surface, wherein movement of the cam surface causes the interval between the bottom of the developer tank and the conveying section to change.

18. The image forming apparatus of claim 14, further comprising a detector for detecting an amount of developer in the developer tank.

19. The image forming apparatus of claim 18, wherein the interval change section changes the interval between the bottom of the developer tank and the conveying section based on a signal from the detector.

20. The image forming apparatus of claim 14, further comprising a detector for detecting when the discharge opening in the developer tank is open.

21. The image forming apparatus of claim 20, wherein the conveying section conveys the developer to the discharge opening in the developer tank after the detector indicates that the discharge opening is open.

22. A method for collecting a waste developer used in and discharged from a developing device including: a developer tank for storing a developer containing toner and carrier; a developer discharge opening which is formed at a bottom of the developer tank and is openable and closable; and a conveying section for conveying to the developer discharge opening the developer stored in the developer tank, the method comprising the steps of:

detecting an amount of the developer in the developer tank; and changing an interval between a bottom of the developer tank and the conveying section in according with a result of a detection in said detecting step.

23. The method of claim 22, wherein the changing step comprises moving the bottom of the developer tank closer to the conveying section.

24. The method of claim 22, wherein the changing step comprises moving the conveying section closer to the bottom of the developer tank.

25. The method of claim 22, wherein the detecting step comprises detecting an amount of developer in the developer tank with a sensor in the developer tank.

26. The method of claim 22, wherein the detecting step comprises detecting an amount of developer that has been discharged from the developer tank after a discharge process has started.

27. The method of claim 22, wherein the detecting step comprises detecting an amount of time that has elapsed since a discharge process has started.

* * * * *